US011255069B2

(12) United States Patent
Boyd et al.

(10) Patent No.: US 11,255,069 B2
(45) **Date of Patent: *Feb. 22, 2022**

(54) FRONT LOADER

(71) Applicant: Kubota Corporation, Osaka (JP)

(72) Inventors: Robert Stewart Boyd, Jefferson, GA (US); Erik Baker, Jefferson, GA (US)

(73) Assignee: Kubota Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/928,748

(22) Filed: Jul. 14, 2020

(65) Prior Publication Data

US 2020/0340202 A1 Oct. 29, 2020

Related U.S. Application Data

(60) Division of application No. 16/011,798, filed on Jun. 19, 2018, now Pat. No. 10,753,063, which is a continuation of application No. 15/855,096, filed on Dec. 27, 2017, now Pat. No. 10,036,138.

(51) Int. Cl.

| | |
|---|---|
| ***E02F 3/627*** | (2006.01) |
| ***E02F 3/36*** | (2006.01) |
| ***E02F 3/34*** | (2006.01) |

(52) U.S. Cl.

CPC ..... *E02F 3/36* (2013.01); *E02F 3/3417* (2013.01); *E02F 3/627* (2013.01); *E02F 3/6273* (2013.01)

(58) Field of Classification Search

None

See application file for complete search history.

(56) References Cited

U.S. PATENT DOCUMENTS

| | | | | |
|---|---|---|---|---|
| 4,347,031 | A | 8/1982 | Friesen et al. | |
| 4,522,554 | A | 6/1985 | Williams et al. | |
| 4,936,737 | A | 6/1990 | Rae et al. | |
| 5,540,289 | A | 7/1996 | Hirooka et al. | |
| 7,281,890 | B2 | 10/2007 | Friesen et al. | |
| 10,036,138 | B1 | 7/2018 | Boyd | |
| 10,370,819 | B2 | 8/2019 | Boyd | |
| 10,753,063 | B2 * | 8/2020 | Boyd | E02F 3/627 |
| 2005/0111953 | A1 | 5/2005 | Westendorf et al. | |
| 2006/0245899 | A1 | 11/2006 | Lyons et al. | |
| 2007/0020078 | A1 | 1/2007 | Frey | |
| 2010/0095563 | A1 | 4/2010 | Webb et al. | |
| 2017/0114517 | A1 * | 4/2017 | Mori | E02F 3/40 |
| 2017/0247854 | A1 | 8/2017 | Hyder | |

FOREIGN PATENT DOCUMENTS

| | | | |
|---|---|---|---|
| DE | 29282778 | A1 | 1/1981 |
| JP | 2016084617 | A | 5/2016 |

* cited by examiner

*Primary Examiner* — Gerald McClain

(74) *Attorney, Agent, or Firm* — The Webb Law Firm

(57) ABSTRACT

A front loader includes a link operating mechanism spanning a bucket and a stand. The link operating mechanism is configured to cause, using a swing force of the bucket, a bending and stretching link to bend so that propping and supporting of the bending and stretching link are released.

3 Claims, 16 Drawing Sheets

Fig.3
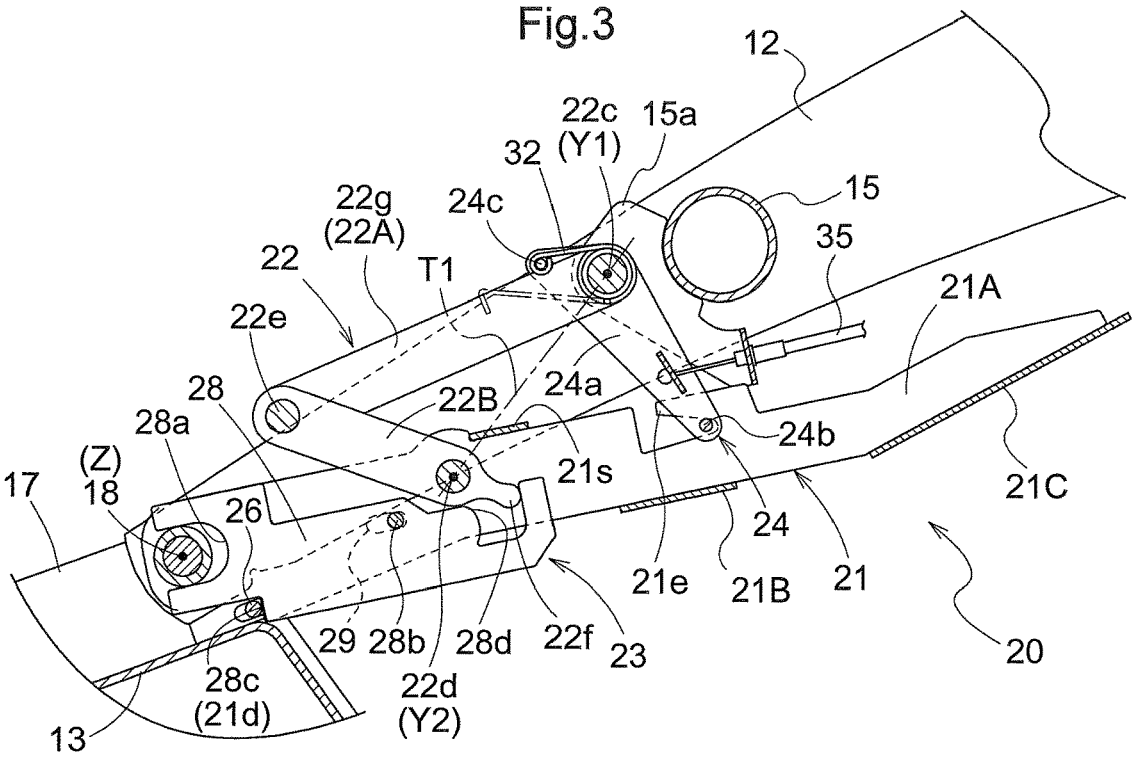
Fig.4
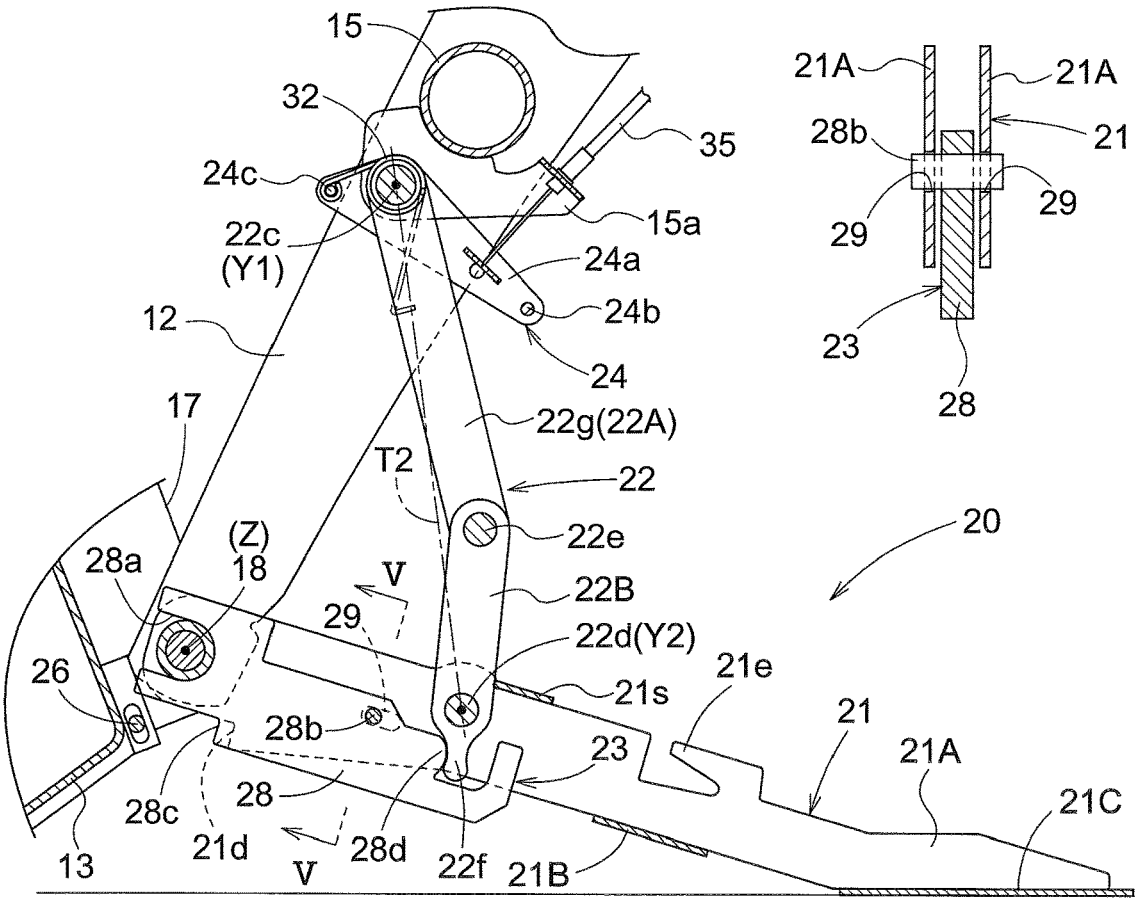
Fig.5

FRONT LOADER

CROSS REFERENCE TO RELATED APPLICATIONS

The present application is a divisional of U.S. patent application Ser. No. 16/011,798 filed Jun. 19, 2018, which is a continuation-in-part of U.S. patent application Ser. No. 15/855,096 filed Dec. 27, 2017, now U.S. Pat. No. 10,036,138, each of which are hereby incorporated by reference in their entirety herein.

BACKGROUND OF THE INVENTION

Field of the Invention

The present invention is directed to a front loader.

Description of the Related Art

As front loaders, there are ones including: a boom removably coupled to a vehicle body; a bucket supported at a front end of the boom; a stand that supports the boom, when removed from the vehicle body, in a state in which the bucket is engaged on the ground; and a support link that is provided spanning the boom and the stand, and is configured to prop and support the stand in the grounded state.

For example, U.S. Pat. No. 4,347,031 discloses a front loader of this type. The front loader disclosed in U.S. Pat. No. 4,347,031 includes a stand body serving as the stand, and a slide mechanism.

RELATED ART DOCUMENT

Patent Document 1: U.S. Pat. No. 4,347,031

SUMMARY OF THE INVENTION

Problem to be Solved by Invention

The stand is required to be stored more compactly so as not to obstruct loader operations. Accordingly, for example, when the front loader is coupled to the vehicle body using a conventional technology and performs loader operations, the stand is folded to be compact using a conventional technology and stored. To fold the stand to be compact, using a bending/stretching link as the support link has also been considered, but there may be cases where the bending/stretching link is unlikely to bend due to strong bending resistance, and thus there is the risk that it will take time to store the stand.

The present invention provides a front loader and a working machine in which a stand can be raised smoothly with a simple structure even if a bending/stretching link has strong bending resistance.

Solution

According to the present invention, the front loader includes:

a boom configured to be removably coupled to a vehicle body;

a bucket supported at a front end of the boom;

a stand configured to support the boom, when removed from the vehicle body, in a state in which the bucket is engaged on the ground;

a bending/stretching link that is provided spanning the boom and the stand, and is configured to prop and support the stand in a state in which the stand is engaged on the ground; and a link operating mechanism that is provided spanning the bucket and the stand, and is configured to cause, using a swing force of the bucket, the bending/stretching link to bend so that the propping and supporting of the bending/stretching link are released.

According to the present configuration, even if the bending/stretching link has strong bending resistance, the bending/stretching link is forcibly caused to bend by the link operating mechanism so that the propping and supporting are released, and thus it is easy for the bending/stretching link to bend compared to a case where it is bent only by the ascending force of the stand, and thus it is possible to smoothly raise the stand.

Since the swing force of the bucket is used as a power source of the link operating mechanism, the structure of the link operating mechanism can be simplified.

According to the present invention, preferably, the link operating mechanism includes a link operating member slidably supported on the stand, the link operating member being configured to abut and press against a lower portion of the bending/stretching link to release the propping and supporting of the bending/stretching link.

According to the present invention, preferably, a pressing operation portion is provided on the bucket, the pressing operation portion being configured to abut, with a swing force of the bucket, against a bucket-side end portion of the link operating member to press the link operating member.

According to the present configuration, with the simple operational structure in which only the pressing operation portion is provided on the bucket, it is possible to achieve an operational structure in which the link operating mechanism is activated with the swing force of the bucket.

According to the present invention, preferably, the bending/stretching link includes a boom-side link swingably supported on the boom, a stand-side link swingably supported on the stand, and a coupling shaft configured to couple a free end of the boom-side link with a free end of the stand-side link to be swingable relative to each other;

the boom-side link is configured to prop and support the stand engaged on the ground as the free end thereof comes into abutment against the stand engaged on the ground;

the link operating mechanism includes an operation target portion provided at the free end of the stand-side link on the side opposite the side where the swing pivot point relative to the stand is located and a link operating portion provided on the bucket; and as the link operating portion comes into abutment against the operation target portion in association with swing of the bucket, the stand-side link is swung by the swing force of the bucket about the swing pivot point and the bending/stretching link is operated to the bending side opposite to the case of propping/supporting.

According to the present configuration, with the simple structure in which only the free end of the boom-side link is placed in abutment against the stand, it is possible to prop and support stand engaged on the ground.

According to the present invention, the front loader includes:

a boom configured to be removably coupled to a vehicle body;

a bucket supported at a front end of the boom;

a stand configured to support the boom, when removed from the vehicle body, in a state in which the bucket is engaged on the ground;

a boom-side link swingably supported on the boom, the boom-side link being configured to prop and support the stand engaged on the ground as the free end thereof comes into abutment against the stand engaged on the ground; and a stand-side link swingably supported on the stand;

wherein as the stand-side link is swung relative to the stand by a swing force of the bucket, the boom-side link is swung by the stand-side link to be swung more upwards relative to the boom than the case of the propping/supporting.

According to the present configuration, as the stand-side link is swung by a swing force of the bucket, the boom-side link is swung more upwards than the case of propping/supporting. Thus, even if the bending/stretching link has strong bending resistance, the boom can be raised smoothly. Further, with the simple structure in which only the free end of the boom-side link is placed in abutment against the stand, it is possible to prop and support stand engaged on the ground.

According to the present invention, preferably, the front loader further comprises:

a holding member posture-switchable between a holding posture in which the holding member is engaged with the stand for holding the stand at a raised/stored posture and a holding releasing posture in which the holding member is released from the stand;

an operation tool manually operable into a locked position for switching the holding member to the holding posture and an unlocked position for switching the holding member to the holding releasing posture;

an inhibiting portion switchable between an inhibition effective state for inhibiting release of the holding member relative to the stand in spite of switchover of the operation tool to the unlocked position and an inhibition releasing state for allowing release of the holding member relative to the stand; and an inhibition switchover mechanism configured to maintain the inhibiting portion under the inhibition effective state as the bucket is supported to the boom under a first set posture and to switch the inhibiting portion to the inhibition releasing state as the bucket is supported to the boom under a second set posture.

According to the present configuration, when the bucket is supported to the boom under the first set posture, the inhibiting portion is maintained under the inhibition effective state by the inhibition switchover mechanism. Thus, even if the operation tool is switched from the locked position to the unlocked position, the holding member is maintained under the holding posture and the stand is kept under the raised/stored posture by the holding member. When the bucket is supported to the boom under the second set posture, the inhibiting portion is switched to the inhibition releasing state by the inhibition switchover mechanism. Thus, as the operation tool is switched from the locked position to the unlocked position, the holding member is changed in its posture to the holding releasing posture and the stand can be lowered from the raised/stored posture to become usable.

Therefore, by setting the bucket as being supported to the boom under the first set posture, e.g. when the vehicle body to which the front loader is coupled is to be parked, even if the operation tool is switched to the unlocked position by e.g. a malicious mischief, the stand can be kept under the raised/stored posture by the holding member.

According to the present invention, preferably, the vehicle body comprises a vehicle body of a working machine.

According to the present configuration, since the stand can be easily raised even if the the bending/stretching link provides strong bending resistance, a loader work can be made ready speedily with coupling of the front loader thereto.

According to the present invention, preferably, the vehicle body includes a riding type driving section and a driving cabin.

According to the present configuration, even in the case of bad weather such as rain, strong wind, etc., operations are possible inside the driving cabin not affected by the effect of such bad weather, so a work can be carried out easily.

According to the present invention, preferably, the driving cabin include an access door; the access door is openable/closable about a pivot shaft provided as a swing pivot point at a vehicle body rear side portion of the access door and oriented vertically of the vehicle body: and the operation tool is provided at a position hand-accessible from a riding space of the riding type driving section.

According to the present configuration, in spite of the provision of the driving cabin, it is possible for a driver to lock the stand under the raised/stored posture or to release the stored locking of the stand without having to exist the driving section.

BRIEF DESCRIPTION OF THE DRAWINGS

FIG. 3 is a side view showing a stand at a raised/stored position;

FIG. 4 is a side view showing the stand at a lowered/used position, and a bending/stretching link in a propping and stretched state;

FIG. 5 is a view in section as taken along and seen in an arrow V-V in FIG. 4;

DETAILED DESCRIPTION OF PREFERRED EMBODIMENTS

Figure 1:
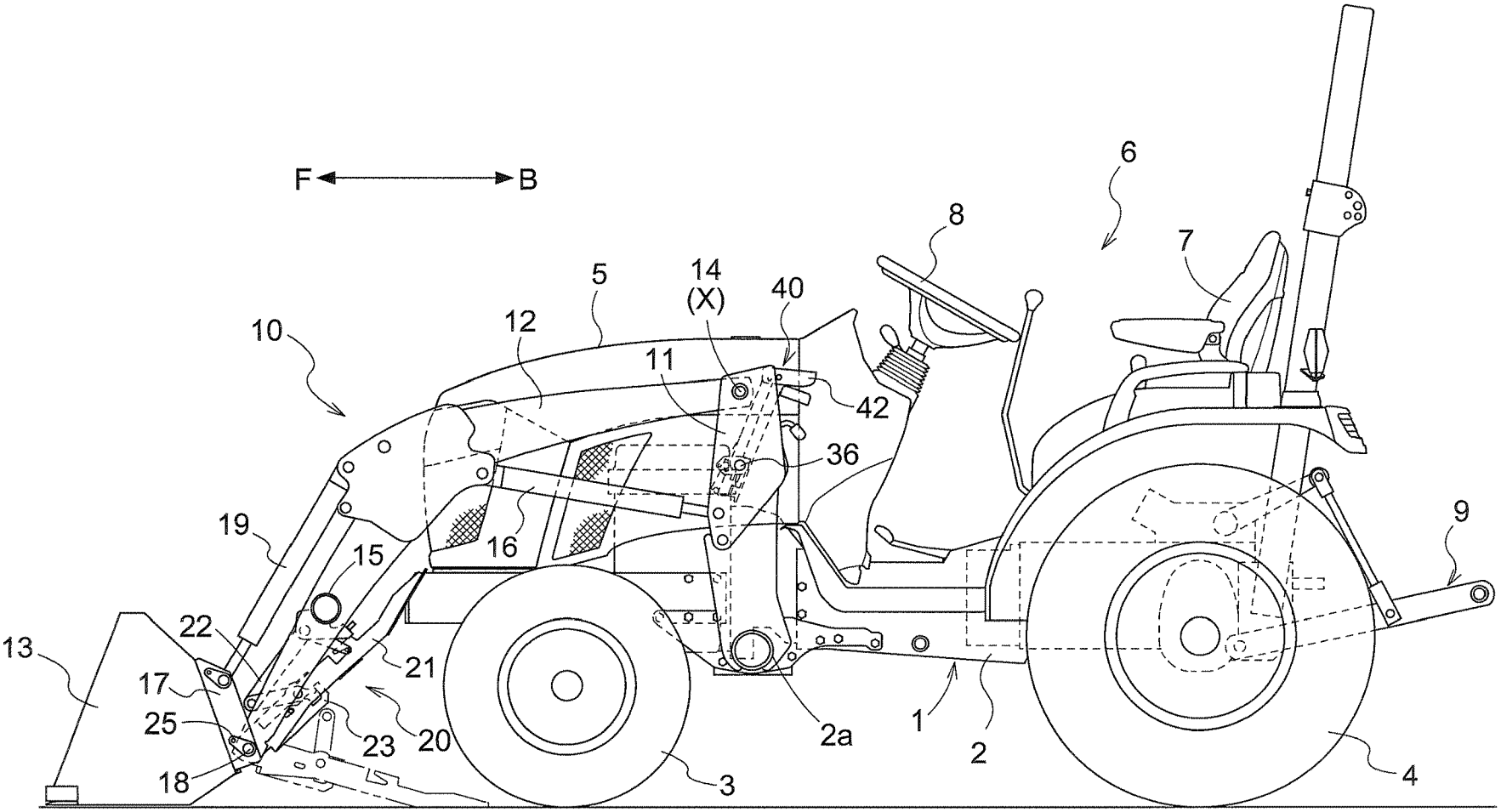
FIG. 1 is a left side view showing a tractor in its entirety to which a front loader is coupled.
Figure 2:
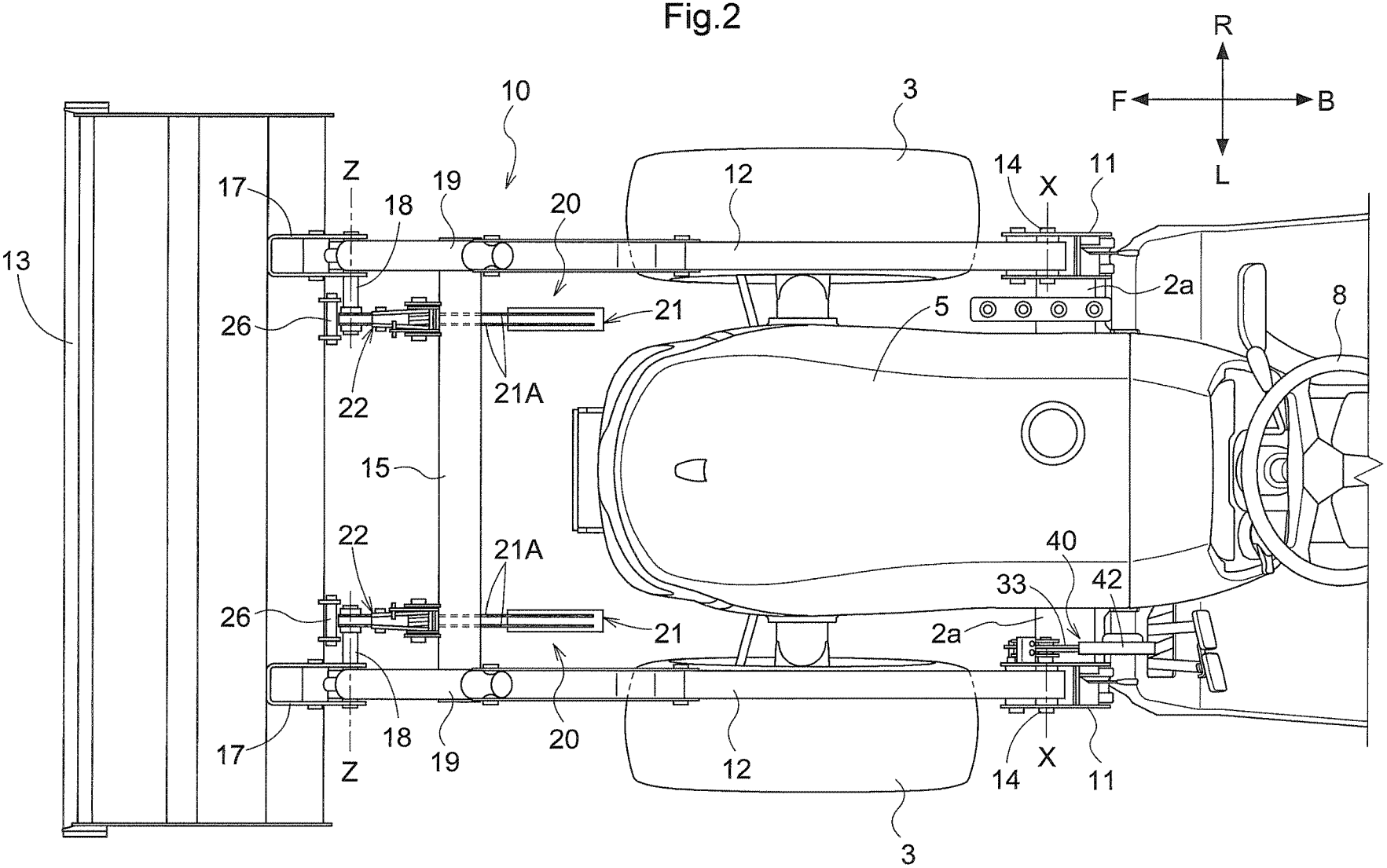
FIG. 2 is a plan view showing a front portion of the tractor and the front loader.

The following will describe embodiments of the present invention when it is applied to a tractor, which is an example of a working vehicle, with reference to the drawings. FIG. 1 is a left side view showing the tractor in its entirety. FIG. 2 is a plan view showing a front portion of the tractor. In FIGS. 1 and 2, the forward direction of a travel vehicle body 1 is defined as a direction [F], and the backward direction of the travel vehicle body 1 is defined as a direction [B], and in FIG. 2, the leftward direction of the travel vehicle body 1 is defined as a direction [L], and the rightward direction of the travel vehicle body 1 is defined as a direction [R].

[Overall Structure of Tractor]

As shown in FIGS. 1 and 2, the tractor includes the travel vehicle body 1 including a vehicle body frame 2 that supports, in its front portion, a pair of left and right front wheels 3 so that they are drivable and steerable, and supports, in its rear portion, a pair of left and right rear wheels 4 so that they are drivable. A prime mover portion 5 with an engine is formed in a front portion of the travel vehicle body 1. A driving portion 6 is formed in a rear portion of the travel vehicle body 1. The driving portion 6 includes a driver seat 7 and a steering wheel 8 for steering the front wheels 3. A link mechanism 9 extends from the rear portion of the travel vehicle body 1 in the backward direction of the vehicle body. Various types of working devices such as a rotary cultivating device (not shown) can be coupled to the rear portion of the travel vehicle body 1 via the link mechanism 9 so as to be raised and lowered, allowing various types of working machines such as a passenger cultivator to be realized. A front loader 10 is removably coupled to the front portion of the travel vehicle body 1.

[Front Loader 10]

As shown in FIGS. 1 and 2, the front loader 10 includes: coupling frames 11 supported on both lateral side portions of the travel vehicle body 1; a left boom 12 that is provided in the left lateral side portion of the front loader 10 and extends from the upper portion of the left coupling frame 11 in the forward direction of the vehicle body; a right boom 12 that is provided in the right lateral side portion of the front loader 10 and extends from the upper portion of the right coupling frame 11 in the forward direction of the vehicle body; and a single bucket 13 that is supported spanning the front ends of the left and right booms 12.

The left and right coupling frames 11 are removably coupled to support portions 2*a* provided in the lateral side portions of the vehicle body frame 2. Support shafts 14 are provided in the base portions of the left and right booms 12, and the left and right booms 12 are supported by the coupling frames 11 via the support shafts 14 so as to be swingable up and down with the axes X of the support shafts 14 that extend in a lateral direction of the vehicle body used as the pivot points. Midway portions of the left and right booms 12 are coupled to each other via a boom coupling frame 15. A left boom cylinder 16 is coupled spanning the left coupling frame 11 and the left boom 12. A right boom cylinder 16 is coupled spanning the right coupling frame 11 and the right boom 12. The left and right booms 12 are raised and lowered through extension and retraction operations of the boom cylinders 16.

Coupling brackets 17 are provided in a left end portion and a right end portion on the back of the bucket 13. The bucket 13 is supported by the left and right booms 12 via coupling shafts 18 mounted on the coupling brackets 17, so as to be swingable up and down with axes Z of the coupling shafts 18 that extend in the lateral direction of the vehicle body used as the pivot points. A left bucket cylinder 19 is coupled spanning the left boom 12 and the left coupling bracket 17. A right bucket cylinder 19 is coupled spanning the right boom 12 and the right coupling bracket 17. The bucket 13 is operated to swing between a scooping posture and a discharging posture with extension and retraction operations of the left and right bucket cylinders 19.

The front loader 10 is coupled to the travel vehicle body 1 as a result of the left and right coupling frames 11 of the front loader 10 being coupled to the support portions 2*a*. In the state in which the front loader 10 is coupled to the travel vehicle body 1, the left boom 12 is coupled to the left lateral side portion of the travel vehicle body 1 so as to be swingable up and down, and the right boom 12 is coupled to the right lateral side portion of the travel vehicle body 1 so as to be swingable up and down. As a result of the left and right booms 12 being raised and lowered, the bucket 13 is raised and lowered with respect to the travel vehicle body 1. The front loader 10 is removed from the travel vehicle body 1 as a result of the left and right coupling frames 11 being removed from the support portions 2*a*. Note however that attaching and detaching a hydraulic pressure hose on the front loader 10 side to and from a hydraulic piping on the travel vehicle body 1 side is performed independently from attaching and detaching the coupling frames 11 to and from the support portions 2*a*.

[Stand]

As shown in FIGS. 1-3, the front loader 10 includes: a left stand unit 20 provided corresponding to the left boom 12; and a right stand unit 20 provided corresponding to the right boom 12. The left and right stand units 20 are each provided with a stand 21, a bending/stretching link 22, a link operating mechanism 23, and a holding member 24. The structures of the left and right stand units 20 differ from each other in that the stand 21, the bending/stretching link 22, and the holding member 24 of the left stand unit 20 are coupled to the left boom 12, and the stand 21, the bending/stretching link 22, and the holding member 24 of the right stand unit 20 are coupled to the right boom 12. Otherwise, the remaining structure of the left and right stand units 20 is the same, and thus the following description will be given without distinguishing between left and right, except for cases where it is necessary to distinguish between left and right.

As shown in FIGS. 2 and 3, the stand 21 includes a pair of left and right longitudinal plate portions 21A arranged side by side at a distance in the lateral direction of the vehicle body, and a first coupling portion 21B and a second coupling portion 21C that are located in lower portions of the pair of left and right longitudinal plate portions 21A. The first coupling portion 21B couples the left and right longitudinal plate portions 21A at an intermediate portion, in the front/rear direction of the vehicle body, of the stand 21. The second coupling portion 21C couples the left and right longitudinal plate portions 21A at a free end portion of the stand 21. The second coupling portion 21C constitutes a ground contact portion of the stand 21. Hereinafter, the second coupling portion 21C is referred to as "ground contact portion 21C".

As shown in FIGS. 2 and 3, the stand 21 is provided on one of two lateral sides of the boom 12 that is closer to the center, in the left-right direction of the vehicle body, of the bucket 13. In other words, the stand 21 is provided inward, in the lateral direction of the vehicle body, of the boom 12. The stand 21 is supported at the front end of the boom 12 via the coupling shaft 18 mounted on the front end of the stand 21, so as to be able to be raised and lowered between a lowered/used position (see FIG. 4) at which it is lowered with respect to the boom 12 with the axis Z of the coupling shaft 18 that extends in the lateral direction of the vehicle body used as the pivot point, and a raised/stored position (see FIG. 3) at which it is raised with respect to the boom 12. The stands 21 are coupled to the booms 12 and the bucket 13 is coupled to the booms 12 using the common coupling shafts 18. Rotation prevention members 25 (see FIG. 1) are each coupled spanning the coupling shaft 18 and the coupling bracket 17 of the bucket 13. The rotation prevention members 25 prevent the coupling shafts 18 from rotating with respect to the coupling brackets 17.

Figure 7:
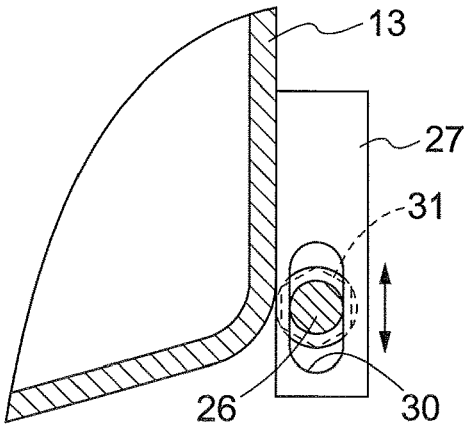
FIG. 7 is a view in vertical section view showing a stand operating portion.

As shown in FIGS. 3 and 4, stand operating portions 26 are provided on the back of the bucket 13. As shown in FIG. 7, the stand operating portions 26 are each constituted by a round bar member coupled to the bucket 13 via a pair of left and right support members 27. The left and right support members 27 are coupled to the bucket 13 through welding. As shown in FIGS. 3 and 4, an operation target portion 21*d* is formed at the front end portion of the stand 21. If the bucket 13 is operated to swing downward, then the stand operating portions 26 hit against the operation target portions 21*d* so that the operation target portions 21*d* are pressed against by the stand operating portions 26, and the stands 21 are raised by the swing force of the bucket 13 and switch to the raised/stored position. If the bucket 13 is operated to swing upward, then the pressing operation of the stand operating portions 26 performed on the operation target portions 21*d* is released, and the stands 21 are lowered by gravity and switch to the lowered/used position.

As shown in FIGS. 2, 3 and 4, the bending/stretching link 22 is provided on a lateral side of the boom 12, spanning the boom 12 and the free end side of the stand 21.

Figure 6:
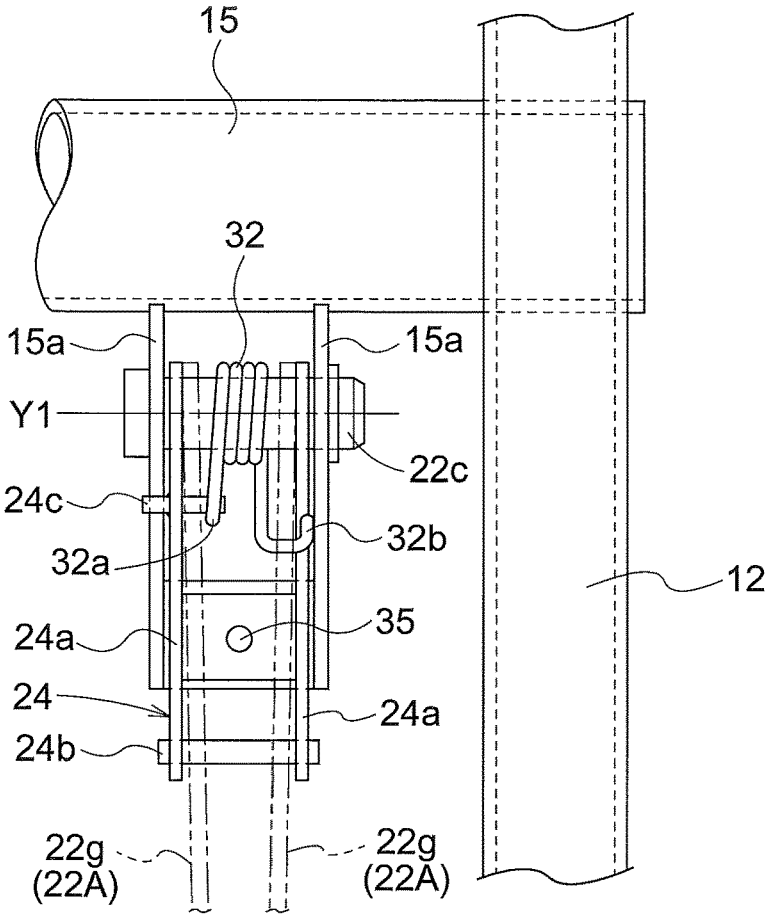
FIG. 6 is a plan view showing a support structure of a holding member.

Specifically, as shown in FIGS. 3 and 4, the bending/stretching link 22 includes a boom-side link 22A and a stand-side link 22B. As shown in FIGS. 3, 4 and 6, the boom-side end portion of the boom-side link 22A is supported by a pair of left and right support portions 15*a* via a support shaft 22*c*. The left and right support portions 15*a* are provided on the boom coupling frame 15 that couples the left and right booms 12. The left and right support portions 15*a* are coupled to the boom coupling frame 15 through welding. The boom-side link 22A is supported on the boom 12 via the support shaft 22*c*, the support portions 15*a*, and the boom coupling frame 15, and the boom-side link 22A is supported on the boom 12 so as to be swingable with a axis Y1 of the support shaft 22*c* that extends in the lateral direction of the travel vehicle body 1 used as the pivot point. As shown in FIGS. 3 and 4, the stand-side end portion of the stand-side link 22B is coupled to the stand 21 via a coupling shaft 22*d*. The stand-side link 22B is coupled to the stand 21 so as to be relatively swingable with a axis Y2 of the coupling shaft 22*d* that is parallel to the axis Y1 used as the pivot point. The free end portion of the boom-side link 22A and the free end portion of the stand-side link 22B are coupled to each other by a coupling shaft 22*e* so as to be relatively swingable. The boom-side link 22A includes a pair of left and right link members 22*g*. The left and right link members 22*g* and the stand-side link 22B are coupled to each other by the coupling shaft 22*e* so as to be relatively swingable in a state in which the free end portion of the stand-side link 22B is sandwiched between the free end portions of the left and right link members 22*g* from both lateral sides.

As shown in FIG. 3, when the stand 21 is at the raised/stored position, the bending/stretching link 22 is in a bent state in which the axis of the coupling shaft 22*e* is located forward of a straight line T1 that connects the axis Y1 of the support shaft 22*c* and the axis Y2 of the coupling shaft 22*d*, when seen from the vehicle body side. As shown in FIG. 6, a coil-shaped spring 32 is supported on the support shaft 22*c*. One-end portion 32*a* of the spring 32 is latched onto a later-described holding member 24, and another-end portion 32*b* of the spring 32 is latched onto one link member 22*g*. As the stand 21 swings downward, the bending/stretching link 22 is operated to stretch from the bent state in which the stand 21 is at the raised/stored position, due to the descending force of the stand 21 and the action force of the spring 32. The bending/stretching link 22 is operated to stretch until the stand-side link 22B hits against a stopper portion 21*s* provided on the stand 21. As shown in FIG. 4, when the stand-side link 22B is in contact with the stopper portion 21*s*, the bending/stretching link 22 is in a stretched state in which the axis of the coupling shaft 22*e* is located rearward of a straight line T2 that connects the axis Y1 of the support shaft 22*c* and the axis Y2 of the coupling shaft 22*d*, when seen from the vehicle body side. The posture change of the bending/stretching link 22 from a stretched state in which the axis Y1 of the support shaft 22*c*, the axis of the coupling shaft 22*e*, and the axis Y2 of the coupling shaft 22*d* are in a straight line, to the stretched state in which the axis of the coupling shaft 22*e* is located rearward of the straight line T2 that connects the axis Y1 of the support shaft 22*c* and the axis Y2 of the coupling shaft 22*d* is made by the action force of the spring 32. Upon reaching the stretched state in which the stand-side link 22B is in contact with the stopper portion 21*s*, the bending/stretching link 22 is stretched while being supported on the stopper portion 21*s* so as to not bend even if a ground reaction force is applied to the stand 21. That is, upon reaching the stretched state in which the bending/stretching link 22 is supported by the stopper portion 21*s*, the bending/stretching link 22 is in a propping and stretched state in which it props and supports the stand 21 at the lowered/used position against the ground reaction force.

As the stand 21 is operated upward, the bending/stretching link 22 is operated to bend due to the ascending force of the stand 21, allowing the stand 21 to change its posture to the raised/stored position.

As shown in FIGS. 3 and 4, the link operating mechanism 23 includes a link operating member 28 and the stand operating portion 26 as a pressing operation portion. As shown in FIG. 5, the link operating member 28 is provided between the left and right longitudinal plate portions 21A of the stand 21, and is covered by the left and right longitudinal plate portions 21A from both lateral sides. The link operating member 28 is protected by the longitudinal plate portions 21A so as to be unlikely to collide with a stone or the like.

As shown in FIGS. 3 and 4, the link operating member 28 has, in the front portion thereof, a cut-out recess 28*a*. The link operating member 28 has, in the rear portion thereof, guide pins 28*b*. As shown in FIG. 5, the guide pins 28*b* protrude outward from both lateral sides of the link operating member 28. In the front portion of the link operating member 28, the cut-out recess 28*a* is slidably fitted to the coupling shaft 18. The guide pins 28*b* on both lateral sides in the rear portion are slidably fitted into mounting holes 29 in the shape of elongated holes that are formed in the left and right longitudinal plate portions 21A of the stand 21 and extend in the longitudinal direction of the stand 21. The front-end side of the link operating member 28 is slidably supported on the stand 21 via the cut-out recess 28*a* and the coupling shaft 18, and the rear end side of the link operating member 28 is slidably supported on the stand 21 via the left and right guide pins 28*b*. The link operating member 28 is supported so as to be slidable in the longitudinal direction of the stand 21.

The link operating member 28 includes, in a bucket side end portion thereof, an operation target portion 28*c*. The link operating member 28 has, in a rear portion thereof, a link operating portion 28*d*. As shown in FIG. 4, when the stand 21 is at the lowered/used position, a lower portion 22*f*, located below the coupling shaft 22*d*, of the stand-side link 22B of the bending/stretching link 22 in the propping and supporting state hits against the link operating portion 28*d* of the link operating member 28, and the link operating member 28 is pressed by the stand-side link 22B to the front, and is supported by the stand 21 in a state in which the operation target portion 28*c* is located forward of the operation target portion 21*d* of the stand 21.

In the link operating mechanism 23, when the stand 21 is at the lowered/used position, upon the bucket 13 swinging downward, the stand operating portion 26 serving as the pressing operation portion hits against, before hitting against the operation target portion 21*d* of the stand 21, the operation target portion 28*c* of the link operating member 28 and presses against the link operating member 28, and the link operating member 28 is operated with the swing force of the bucket 13 to slide rearward in the longitudinal direction of the stand 21. When the link operating member 28 is operated to slide, the link operating portion 28*d* of the link operating member 28 hits against the lower portion 22*f* of the stand-side link 22B and presses against the lower portion 22*f* of the stand-side link 22B, and the bending/stretching link 22 is operated by the link operating member 28 so that the propping and supporting state is released. That is, prior to the stand operating portion 26 hitting against the operation target portion 21*d* of the stand 21 to start raising the stand 21, the stand operating portion 26 hits against the operation target portion 28*c* of the link operating member 28 so that the link operating member 28 is pressed rearward by the stand operating portion 26 and the bending/stretching link 22 is forcibly operated by the link operating member 28 so as to bend, thus releasing the propping and supporting state.

As shown in FIG. 7, mounting holes 30 for round bar member that are formed in the left and right support members 27 are elongated hole shaped. The round bar member moves in the mounting holes 30 in an adjusted manner in a direction that corresponds to the swing direction of the bucket 13, and is configured to be fastened and fixed at the adjusted position with screw members 31. By adjusting the position at which the round bar member is to be fixed, it is possible to adjust the timings at which, with the swinging of the bucket 13, the stand operating portion 26 hits against the operation target portion 28*c* of the link operating member 28 and the operation target portion 21*d* of the stand 21. It is possible to adjust the timing for the left stand unit 20 and the timing for the right stand unit 20 separately.

As shown in FIGS. 3, 4 and 6, the holding member 24 is mounted on a lateral side of the boom 12. The holding member 24 is supported on the pair of left and right support portions 15*a* via the support shaft 22*c*. The holding member 24 is supported on the boom 12 via the support shaft 22*c*, the support portions 15*a*, and the boom coupling frame 15, and is supported so as to be swingable between a holding posture and a releasing posture with the axis Y1 of the support shaft 22*c* used as the pivot point. The holding member 24 includes a pair of left and right holding plates 24*a* supported by the support shaft 22*c*, and a coupling pin 24*b* that couples the free end sides of the left and right holding plates 24*a*.

As shown in FIG. 3, when the holding member 24 is switched to the holding posture in the state in which the posture of the stand 21 has changed to the raised/stored position, the holding member 24 engages, using the coupling pin 24*b*, with a hook portion 21*e* provided in the stand 21, and the stand 21 is held at the raised/stored position by the holding member 24. When the posture of the holding member 24 is switched to the releasing posture, the coupling pin 24*b* disengages from the hook portion 21*e* to allow the stand 21 to lower from the raised/stored position.

As shown in FIGS. 3, 4 and 6, one of the holding plates 24*a* includes a spring latch portion 24*c* in the portion opposite to the side on which the coupling pin 24*b* is located, with respect to the support shaft 22*c*. One-end portion 32*a* of the spring 32 is latched onto the spring latch portion 24*c*. The holding member 24 is biased by the spring 32, serving as an elastic member, to swing into the releasing posture. In place of the spring 32, various types of elastic members such as a piece of rubber may also be employed.

Figure 8:
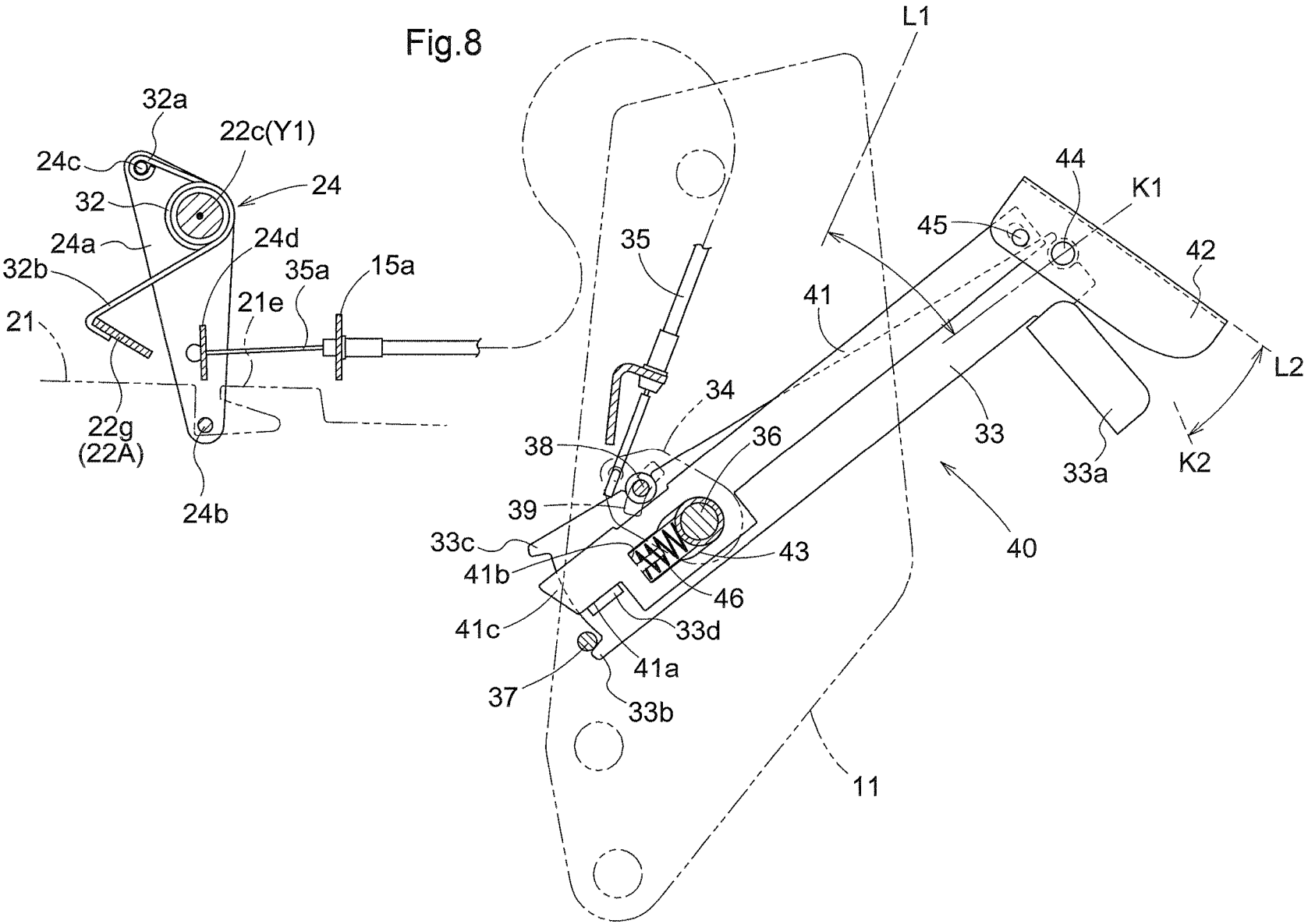
FIG. 8 is a side view showing a coupling structure between the holding member and an operation tool, and the operation tool at an unlocked position.

As shown in FIG. 8, the holding member 24 includes a wire coupling portion 24*d*. The wire coupling portion 24*d* is formed in a portion of the holding member 24 that is located between the support shaft 22*c* and the coupling pin 24*b*, spanning the pair of holding plates 24*a*. As a result of an inner wire 35*a* of a wire 35 being coupled between the wire coupling portion 24*d* and a wire coupling portion 34 of an operation tool 33, the holding member 24 and the operation tool 33 are coupled to each other via the wire 35.

Figure 9:
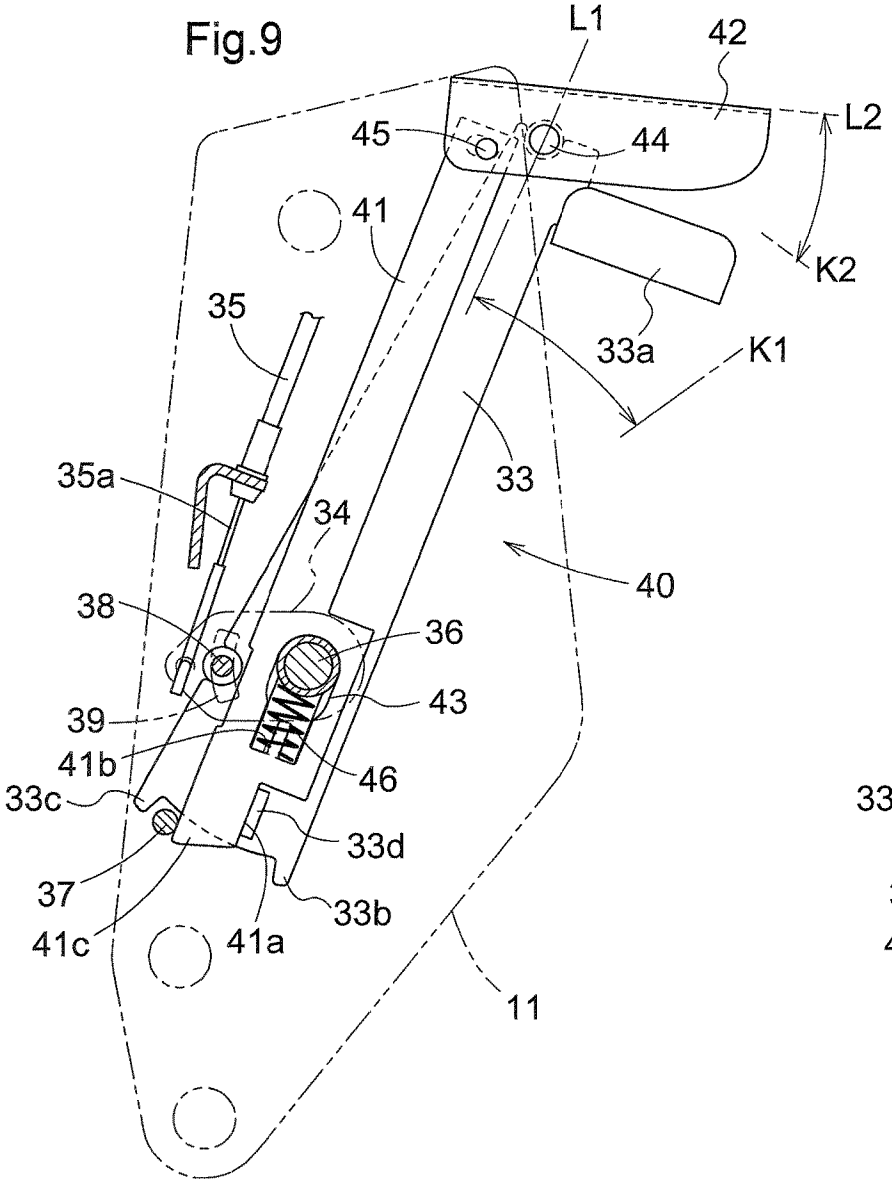
FIG. 9 is a side view showing the operation tool at a locked position, and an operation tool locking mechanism in a locking state.

As shown in FIGS. 2 and 8, the operation tool 33 is supported inward of the vehicle body in a lateral side portion of the left coupling frame 11 via a support shaft 36, and is supported so as to be swingable between a locked position L1 and an unlocked position K1 with the support shaft 36 used as the pivot point. As shown in FIG. 8, the operation tool 33 includes, in the upper portion thereof, a grip portion 33*a* serving as an operation portion for an operator to operate the operation tool 33. As shown in FIG. 8, the operation tool 33 is at the unlocked position K1, as a result of the grip portion 33*a* being operated to the lower side until a first positioning portion 33*b* formed in the base portion of the operation tool 33 hits against a stopper 37. As shown in FIG. 9, the operation tool 33 is at the locked position L1, as a result of the grip portion 33*a* being operated to the upper side until a second positioning portion 33*c* formed in the base portion of the operation tool 33 hits against the stopper 37. The stopper 37 is formed on the coupling frame 11.

Figure 11:
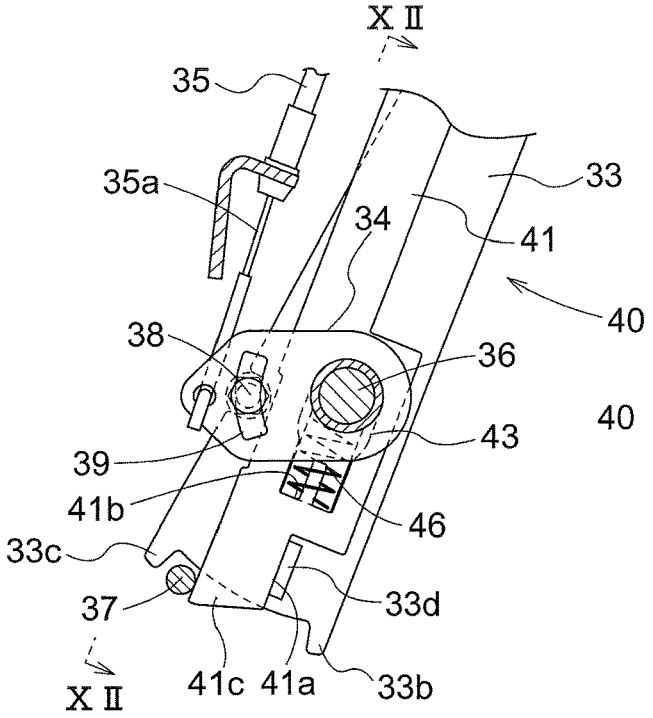
FIG. 11 is a side view showing a structure in which a wire is coupled to the operation tool.
Figure 12:
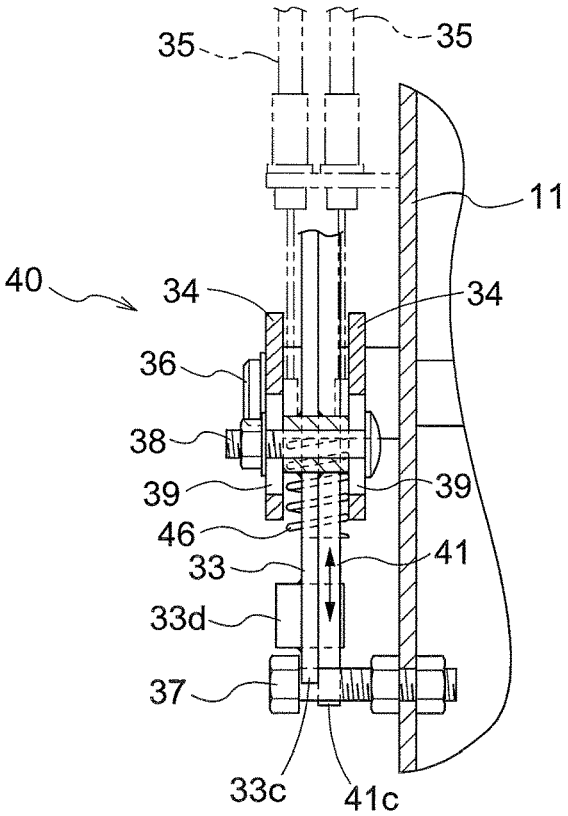
FIG. 12 is a view in section as taken along and seen in an arrow XII-XII in FIG. 11.

As shown in FIGS. 8, 11 and 12, the wire coupling portion 34 of the operation tool 33 is supported on the operation tool 33 via the support shaft 36 and a positioning screw member 38. A screw member hole 39 through which the positioning screw member 38 of the wire coupling portion 34 is inserted has the shape of an arc-like elongated hole with the axis of the support shaft 36 located in the center. By releasing the wire coupling portion 34 fastened to the operation tool 33 by the positioning screw member 38, the wire coupling portion 34 can swing relative to the operation tool 33 using the support shaft 36 as the pivot point, within the range of the screw member hole 39, and thus it is possible to change and adjust the position of the operation tool 33 to which the wire coupling portion 34 is coupled. By screwing the positioning screw member 38 to fasten the wire coupling portion 34 to the operation tool 33, it is possible to fix the wire coupling portion 34 to the operation tool 33 at the changed and adjusted coupling position.

As shown in FIG. 9, as a result of the operation tool 33 being brought into the locked position L1, the inner wire 35*a* is drawn and the holding member 24 is switched to the holding posture against the force of the spring 32. As shown in FIG. 8, as a result of the operation tool 33 being brought into the unlocked position K1, the inner wire 35*a* loosens and the holding member 24 is switched to the releasing posture by the spring 32.

As shown in FIG. 8, an operation tool locking mechanism 40 is provided spanning the operation tool 33 and the coupling frame 11. The operation tool locking mechanism 40 includes a lock member 41 and an unlock operation tool 42, and is also provided with the stopper 37 that acts on the operation tool 33, as a stopper that acts on the lock member 41.

As shown in FIG. 8, the lock member 41 is provided between the operation tool 33 and the coupling frame 11. The base portion of the lock member 41 includes a mounting hole 43 in the shape of an elongated hole through which the support shaft 36 is inserted, and a guide target portion 41*a* that is slidably supported on a supporting guide portion 33*d* formed on the operation tool 33. The base portion of the lock member 41 is slidably supported on the operation tool 33 via the mounting hole 43, the support shaft 36, and the guide target portion 41*a*. The unlock operation tool 42 is supported on the grip portion 33*a* of the operation tool 33 via a support shaft 44. One-end portion of the unlock operation tool 42 and the top end of the lock member 41 are operably coupled to each other via a coupling pin 45. The top end side of the lock member 41 is supported on the operation tool 33 via the coupling pin 45, the unlock operation tool 42, and the support shaft 44.

Figure 10:
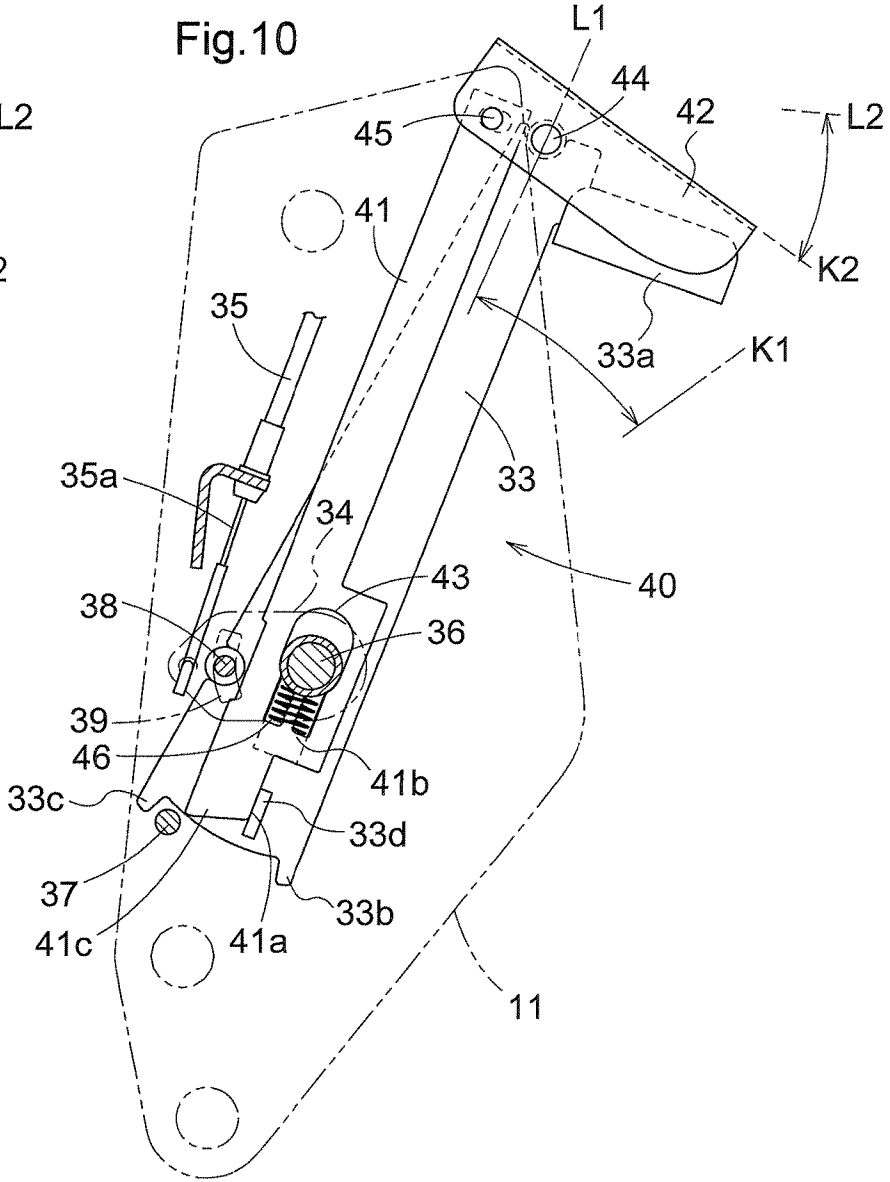
FIG. 10 is a side view showing the operation tool at the locked position, and the operation tool locking mechanism in an unlocking state.

As shown in FIGS. 8 and 10, the unlock operation tool 42 is supported on the grip portion 33*a* so as to be swingable with the support shaft 44 used as the pivot point, between an operation tool unlocking position K2 and an operation tool locking position L2. The unlock operation tool 42 is supported so that it is possible to grip the unlock operation tool 42 together with the grip portion 33*a* of the operation tool 33. The unlock operation tool 42 is supported so as to come into the operation tool unlocking position K2 when it is gripped together with the grip portion 33*a*. The unlock operation tool 42 and the grip portion 33*a* are coupled to each other so that the free end side of the unlock operation tool 42 overlaps the grip portion 33*a* from above when the unlock operation tool 42 is at the operation tool unlocking position K2. It is easy to grip the unlock operation tool 42 and the grip portion 33*a* together.

As shown in FIGS. 8, 9 and 10, the lock member 41 includes a spring receiving portion 41*b* below the mounting hole 43 in the lock member 41. A spring 46 is arranged between the spring receiving portion 41*b* and the support shaft 36. The spring 46 extends from the spring receiving portion 41*b* and is supported on a spring support portion that enters the coil of the spring 46. The lock member 41 is biased by the spring 46 to be lowered with respect to the operation tool 33, and the unlock operation tool 42 is biased to the operation tool locking position L2 when the lock member 41 is biased to be lowered by the spring 46.

As shown in FIG. 9, when the unlock operation tool 42 is brought into the operation tool locking position L2, the lock member 41 is lowered with respect to the operation tool 33 by the spring 46, and a lock portion 41*c* formed in the base portion of the lock member 41 is caused to protrude from the operation tool 33 toward the stopper 37. When the lock portion 41*c* is caused to protrude, the lock portion 41*c* can engage with the stopper 37 on the side of the stopper 37 that is opposite to the side on which the second positioning portion 33*c* of the operation tool 33 is located. As shown in FIG. 10, when the unlock operation tool 42 is brought into the operation tool unlocking position K2, the lock member 41 is raised with respect to the operation tool 33 against the force of the spring 46 due to the swing force of the unlock operation tool 42. When the lock member 41 is raised, the lock portion 41*c* is retracted upward relative to the stopper 37, and can disengage from the stopper 37.

In the operation tool locking mechanism 40, when, as shown in FIG. 9, the operation tool 33 is at the locked position L1 and the lock member 41 is lowered with respect to the operation tool 33 due to the action force of the spring 46, the lock portion 41*c* engages with the stopper 37, resulting in the operation tool locking mechanism 40 being in the locking state. Accordingly, the operation tool 33 is held at the locked position L1 by the operation tool locking mechanism 40 against the force of the spring 32 that acts on the operation tool 33 via the wire 35 and the holding member 24. When the operation tool locking mechanism 40 is in the locking state, the free end side of the unlock operation tool 42 swings upward with respect to the grip portion 33*a* due to the action force of the spring 46 with the support shaft 44 used as the pivot point, and the unlock operation tool 42 moves to the operation tool locking position L2.

In the operation tool locking mechanism 40, when, as shown in FIG. 10, the unlock operation tool 42 is gripped together with the grip portion 33*a* of the operation tool 33 and is brought into the operation tool unlocking position K2, the lock member 41 is raised with respect to the operation tool 33 against the force of the spring 46 and the lock portion 41*c* is disengaged from the stopper 37, resulting in the operation tool locking mechanism 40 being in the unlocking state. Accordingly, holding of the operation tool 33 the locked position L1 by the operation tool locking mechanism 40 is released.

When the operation tool 33 is brought into the unlocked position K1, the lock portion 41*c* of the lock member 41 runs on the stopper 37, and is stopped and supported by the stopper 37 so that the lock member 41 is not lowered with respect to the operation tool 33, and thus the unlock operation tool 42 is held at the operation tool unlocking position K2. When the operation tool 33 is switched from the unlocked position K1 to the locked position L1, the lock portion 41*c* slides relative to the stopper 37 while running on the stopper 37 until the operation tool 33 reaches the locked position L1, and the lock member 41 is retained and supported by the stopper 37 so as to not be lowered with respect to the operation tool 33. When the operation tool 33 is at the locked position L1, the lock portion 41*c* no longer runs on the stopper 37 but engages with the stopper 37.

When the holding member 24 is switched from the holding releasing posture to the holding posture, the operation tool locking mechanism 40 is held in the unlocking state until the operation tool 33 is switched to the locked position L1, and thus it is possible to switch the operation tool 33 to the locked position L1 from the unlocked position K1 without bringing the unlock operation tool 42 into the operation tool unlocking position K2, and to switch the holding member 24 to the holding posture. When the operation tool 33 is at the locked position L1, the operation tool locking mechanism 40 is switched to the locking state by the spring 46, the operation tool 33 is held at the locked position L1 by the operation tool locking mechanism 40, and the holding member 24 is held in the holding posture against the force of the spring 32.

As shown in FIGS. 11 and 12, the operation tool 33 includes: a wire coupling portion 34 that is operably coupled to the holding member 24 of the left stand unit 20 via the wire 35; and a wire coupling portion 34 that is operably coupled to the holding member 24 of the right stand unit 20 via the wire 35. The left wire coupling portion 34 and the right wire coupling portion 34 have the same configuration. As shown in FIG. 12, the left wire coupling portion 34 is fixed to the operation tool 33 and the right wire coupling portion 34 is fixed to the operation tool 33 using the common positioning screw member 38.

The holding members 24 of the left and right stand units 20 are operably coupled to the operation tool 33 common to the left and right stand units 20, and thus it is possible to switch the holding members 24 of the left and right stand units 20 together between the holding posture and the releasing posture simply by operating the operation tool 33. Furthermore, it is possible to change and adjust the coupling position of the operation tool 33 to which the wire 35 of the left holding member 24 is coupled, by adjusting the coupling position between the operation tool 33 and the wire coupling portion 34 to which the wire 35 of the holding member 24 of the left stand unit 20 is coupled. It is possible to change and adjust the coupling position of the operation tool 33 to which the wire 35 of the right holding member 24 is coupled, by adjusting the coupling position between the operation tool 33 and the wire coupling portion 34 to which the wire 35 of the holding member 24 of the right stand unit 20 is coupled. Even if there is slack in the wire 35 or an error in mounting of the left and right holding members 24, it is possible to separately change and adjust the coupling position of the operation tool 33 to which the wire 35 of the left holding member 24 is coupled, and the coupling position of the operation tool 33 to which the wire 35 of the right holding member 24, and it is possible to perform wire adjustment so that the left and right holding members 24 synchronously change their postures between the holding posture and the releasing posture.

Figure 13A:
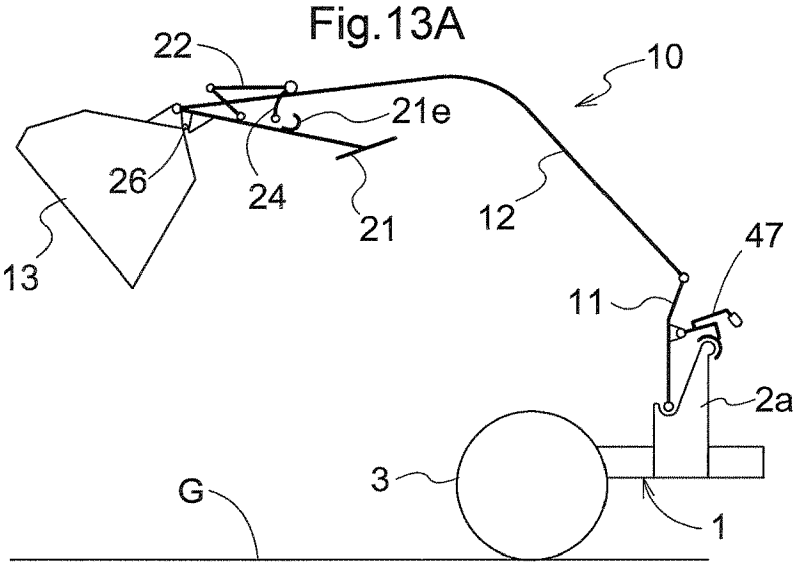
FIG. 13A is a diagram showing how to remove the front loader.

The front loader 10 is removed from the travel vehicle body 1 in accordance with the procedure shown from FIGS. 13A to 13E. As shown in FIG. 13A, the booms 12 are raised to lift the stands 21 at the raised/stored position. The bucket 13 is swung downward, and the stands 21 are brought into the state in which, even if holding of the stands 21 at the raised/stored position by the holding members 24 is released, they do not lower at once, as a result of the stand operating portions 26 receiving the operation target portions 21*d* of the stands 21, namely, as shown in FIG. 3, the stand operating portions 26 hitting against the operation target portions 21*d* of the stands 21 or being located in the vicinity of the front portions of the operation target portions 21*d*, and then the operation tool 33 is brought into the unlocked position K1 to switch the holding members 24 to the releasing posture. When the operation tool 33 is brought into the unlocked position K1, the unlock operation tool 42 is gripped together with the grip portion 33*a* of the operation tool 33, whereby the operation tool locking mechanism 40 is switched to the unlocking state, making it possible to bring the operation tool 33 into the unlocked position K1.

Figure 13B:
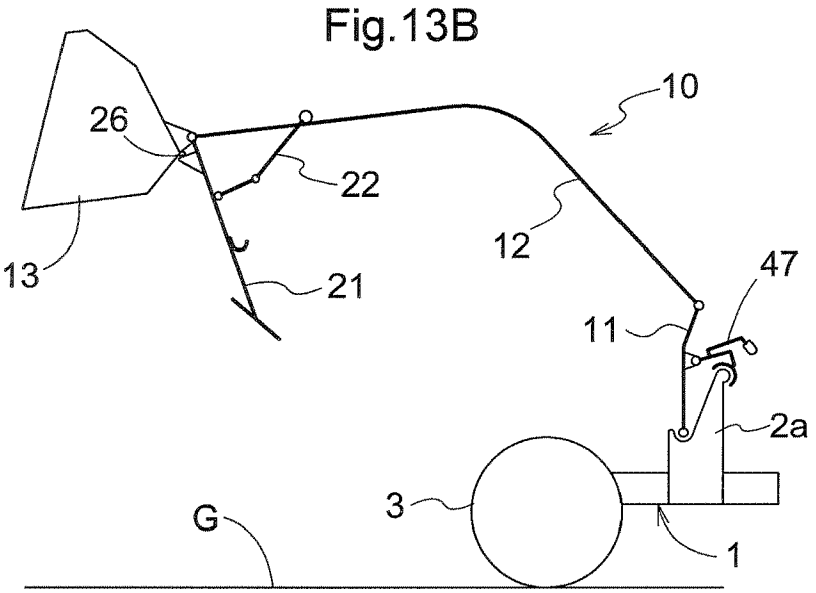
FIG. 13B is another diagram showing how to remove the front loader.

Upon completion of the switching of the holding members 24 to the releasing posture, as shown in FIG. 13B, the bucket 13 is raised to move the stand operating portions 26 upward, and the stands 21 are lowered.

Figure 13C:
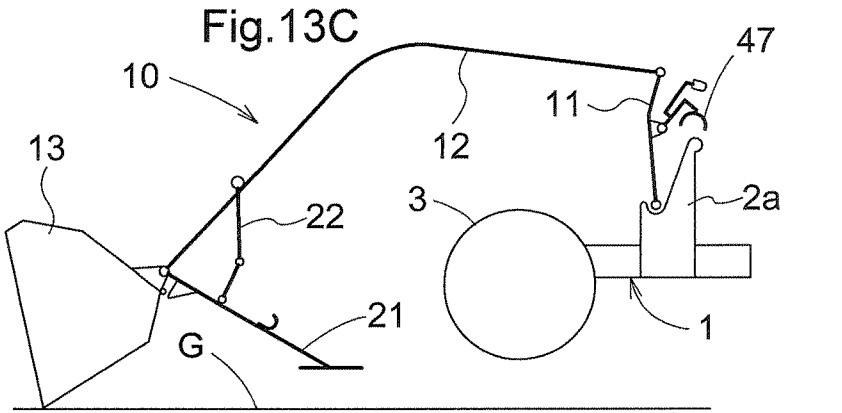
FIG. 13C is still another diagram showing how to remove the front loader.

As shown in FIG. 13C, when the stands 21 are at the lowered/used position, the booms 12 are lowered and the bucket 13 is brought into contact with the ground. When the bucket 13 is engaged on the ground, the booms 12 are further lowered, and the front wheels 3 are raised from the ground. When the front wheels 3 are raised from the ground, coupling locking mechanisms 47 that keep the left and right coupling frames 11 coupled to the support portions 2*a* are switched to an unlocking state.

Figure 13D:
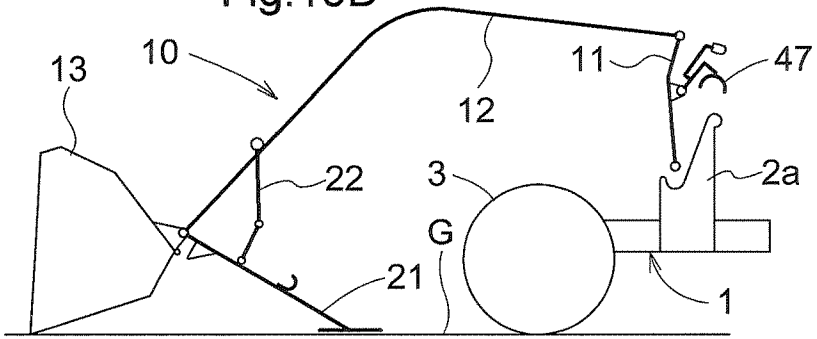
FIG. 13D is yet still another diagram showing how to remove the front loader.

As shown in FIG. 13D, the left and right coupling frames 11 are unlocked and uncoupled from the support portions 2*a*, the front wheels 3 are engaged on the ground G, and then the bucket 13 is raised slightly so that the stands 21 are adjusted into a posture-to-ground in which the ground contact portions 21C are engaged on the ground. Specifically, when the stands 21 are brought into contact with the ground, the booms 12 are raised so that the coupling frame sides of the booms 12 are raised with the sides of the booms 12 that are coupled to the bucket 13 used as the pivot points, and the coupling frames 11 are raised with respect to the support portions 2*a*, thus uncoupling the coupling frames 11 from the support portions 2*a*.

Figure 13E:
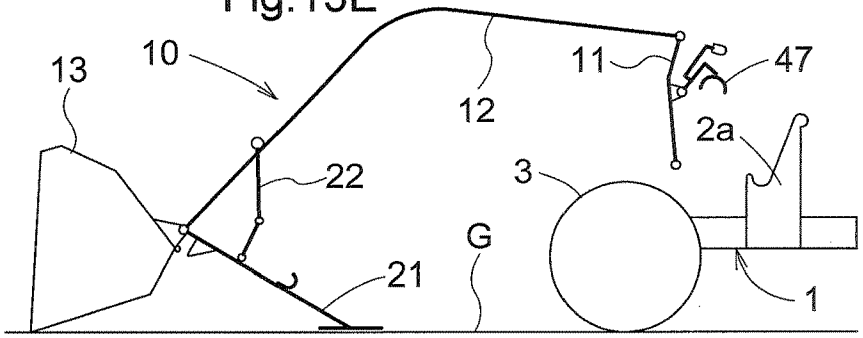
FIG. 13E is a further diagram showing how to remove the front loader.

As shown in FIG. 13E, when the coupling frames 11 are uncoupled from the support portions 2*a*, the travel vehicle body 1 is moved backward so that the coupling frames 11 are located in front of the support portions 2*a*. Because the bending/stretching links 22 are in the propping and stretched state, and the stands 21 are kept at the lowered/used position against the ground reaction force, the booms 12 are supported off the ground in a posture-to-ground when the coupling frames 11 are uncoupled from the support portions 2*a*, due to the stands 21 being supported by the ground and the bucket 13 being supported by the ground. Accordingly, when coupling the front loader 10 to the travel vehicle body 1 later, it is possible to couple the coupling frames 11 to the support portions 2*a* without adjusting the posture-to-ground of the booms 12.

When the booms 12 are supported by the ground, the hydraulic pressure hose on the front loader side is separated from the hydraulic piping on the vehicle body side, whereby it is possible to move the travel vehicle body 1 with the front loader 10 still left on the ground.

When coupling the front loader 10 to the travel vehicle body 1, it is possible to operate the bucket 13, the booms 12, and the like in the reverse order of the above-described order of removing them from the travel vehicle body 1, without adjusting the posture-to-ground of the booms 12, to couple the front loader 10 to the travel vehicle body 1.

When the front loader 10 is supported by the ground, as shown in FIG. 4, the bending/stretching links 22 are in the propping and stretched state, and the link operating members 28 are supported on the stands 21 in a state in which the operation target portions 28*c* are located forward of the operation target portions 21*d* of the stands 21. Accordingly, when the coupling frames 11 are coupled to the support portions 2*a*, and then the stands 21 are raised and stored, the stand operating portions 26 of the bucket 13 first hit against the operation target portions 28*c* of the link operating members 28 to operate the link operating mechanisms 23 using the swing force of the bucket 13, and the bending/stretching links 22 in the propping and stretched state are operated to bend by the link operating mechanisms 23 so that the propping and stretched state is released. Then, the stand operating portions 26 of the bucket 13 hit against the operation target portions 21*d* of the stands 21, and the stands 21 start to be raised with the swing force of the bucket 13. Subsequently, the stands 21 are raised with the swing force of the bucket 13 into the raised/stored position while bending the bending/stretching links 22.

When the stands 21 are at the raised/stored position, the operation tool 33 is switched to the locked position L1. At this time, the lock portion 41*c* of the lock member 41 runs on the stopper 37, and the unlock operation tool 42 reaches the operation tool unlocking position K2, and thus it is possible to switch the operation tool 33 to the locked position L1, simply by operating the operation tool 33 using the grip portion 33*a* without operating the unlock operation tool 42.

When the operation tool 33 is switched to the locked position L1, the holding members 24 are switched to the holding posture, and engage with the hook portions 21*e* of the stands 21. When the operation tool 33 is switched to the locked position L1, the operation tool locking mechanism 40 is switched to the locking state by the spring 46, and the operation tool 33 is held at the locked position L1 by the operation tool locking mechanism 40. Accordingly, the holding members 24 are held in the holding posture, and it is possible to perform front loader operations while the holding members 24 holds the stands 21 at the raised/stored position.

In the front loader operations, when the booms 12 are raised and lowered so that the bucket 13 is raised and lowered, it is demanded that the bucket 13 can be raised and lowered while keeping a set posture-to-ground such as a scooping posture, without adjusting the extension and retraction operation of the bucket cylinders 19 together with the extension and retraction operation of the boom cylinders 16.

Figure 14:
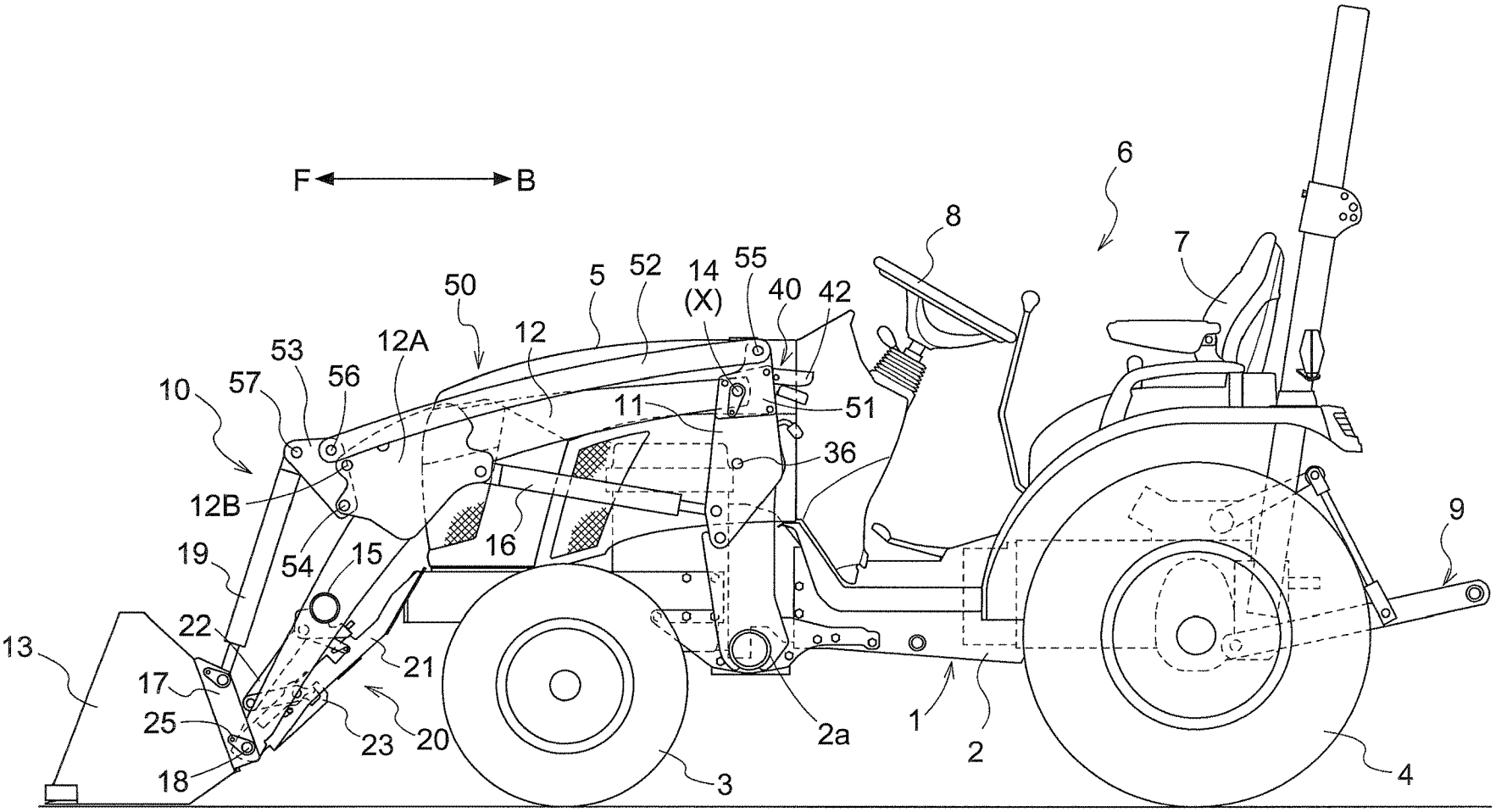
FIG. 14 is a left side view showing the tractor to which the front loader is coupled, and to which a removable posture keeping mechanism is coupled.

FIG. 14 is a left side view showing the tractor to which the front loader 10 and removable posture keeping mechanisms 50 are coupled.

As shown in FIG. 14, the posture keeping mechanisms 50 are respectively coupled to the left boom 12 and the right boom 12. The left posture keeping mechanism 50 and the right posture keeping mechanism 50 have the same configuration. The left and right posture keeping mechanisms 50 are each provided with a link stay 51, a pair of left and right posture keeping links 52, and a swing link 53.

As shown in FIG. 14, the link stay 51 is removably coupled to the upper portion of the coupling frame 11 with multiple connecting bolts. The link stay 51 has a support shaft hole through which the support shaft 14 is inserted at the position at which it is supported by the coupling frame 11. The swing link 53 is removably coupled to an intermediate portion 12A of the boom 12 via a support shaft 54. The swing link 53 is supported on the boom 12 so as to be swingable with the support shaft 54 used as the pivot point.

The pair of left and right posture keeping links 52 are respectively arranged inward, in the lateral direction of the vehicle body, of the link stay 51 and the swing link 53, and outward, in the lateral direction of the vehicle body, of the link stay 51 and the swing link 53. The rear end portions of the pair of left and right posture keeping links 52 are supported in the portion of the link stay 51 that is located above the support shaft 14 so as to be swingable via the support shaft 55. The front-end portions of the pair of left and right posture keeping links 52 are supported in the portion of the swing link 53 that is located above the support shaft 54 so as to be swingable via the support shaft 56.

The boom-side end portions of the bucket cylinders 19 are removed from the cylinder support portions 12B of the intermediate portions 12A of the booms 12, and are supported on the free end portions of the swing links 53 so as to be swingable via the support shafts 57.

When the booms 12 are raised and lowered, the swing links 53 are operated to swing by the posture keeping links 52 with the support shaft 54 used as the pivot point, and the swing force of the swing links 53 is transferred to the coupling brackets 17 of the bucket 13 via the bucket cylinders 19 so that the bucket 13 is operated to swing with respect to the booms 12 with the coupling shafts 18 used as the pivot points.

Accordingly, a posture-to-ground that the bucket 13 is to keep, such as the scooping posture, is set in advance, by adjusting the extension and retraction of the bucket cylinders 19. Accordingly, when the booms 12 are raised and lowered to raise and lower the bucket 13, the bucket 13 is raised and lowered while keeping the posture-to-ground set in advance using the posture keeping mechanisms 50, without performing posture adjustment of the bucket 13 to the booms 12 using extension and retraction adjustment of the posture of the bucket cylinders 19.

[Other Embodiments]

Figure 15:
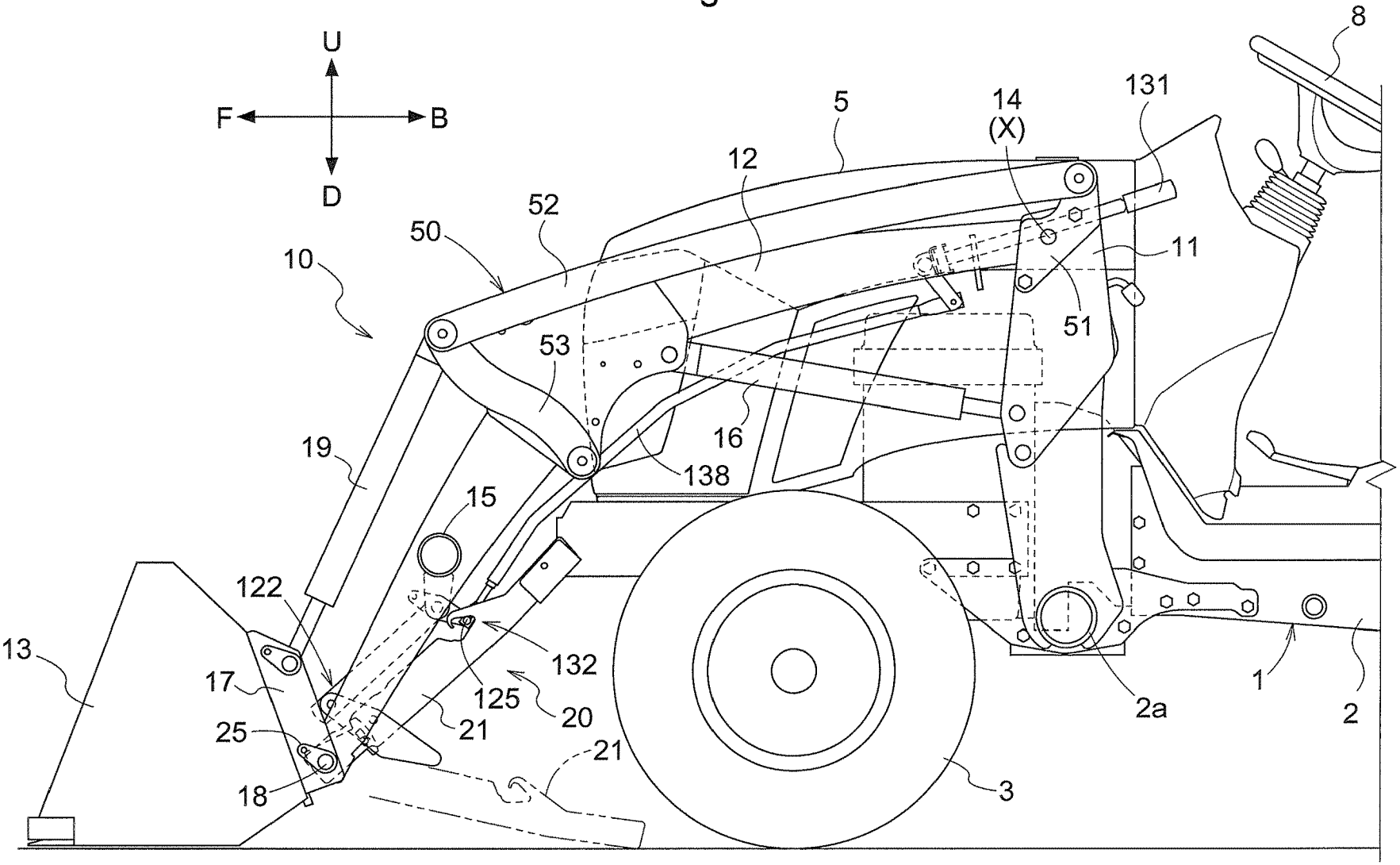
FIG. 15 is a left side view showing a front loader having a further embodiment.
Figure 16:
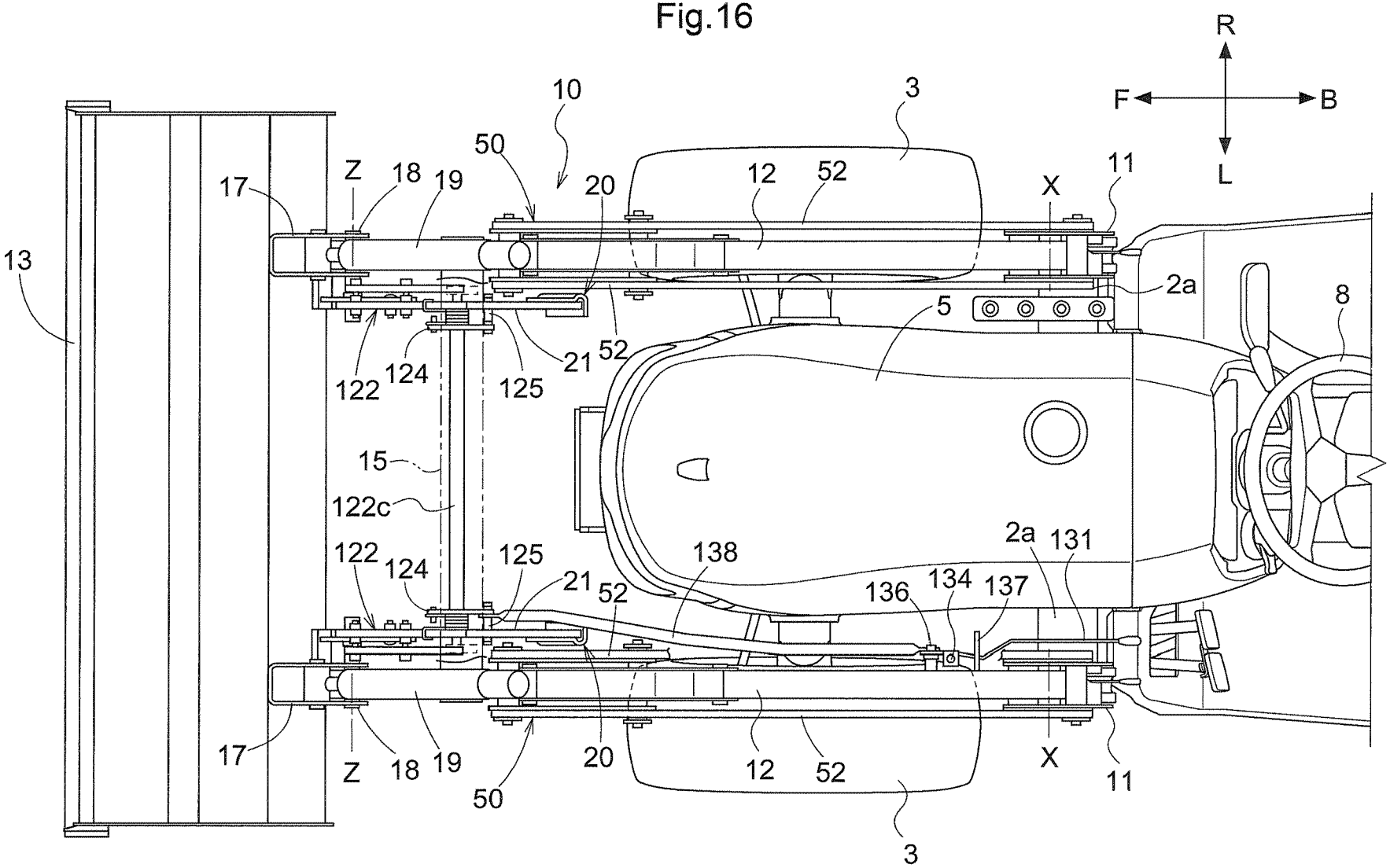
FIG. 16 is a plan view showing the front loader having a further embodiment.

(1) FIG. 15 is a left side view showing a front loader 10 having a further embodiment. FIG. 16 is a plan view showing the front loader 10 having the further embodiment. The front loader 10 having the further embodiment includes a bending/stretching link 122 having a further embodiment, a link operating mechanism 123 having a further embodiment, and a stand operation unit 200 having a further embodiment. In the following discussion, the direction denoted with arrow F in FIGS. 15 and 16 is defined as "vehicle body front side" and the direction denoted with arrow B in the same is defined as "vehicle body rear side". The direction denoted with arrow U in FIG. 15 is defined as "vehicle body upper side" and the direction denoted with arrow D in FIG. 16 is defined as "vehicle body lower side, the direction denoted with arrow L shown in FIG. 16 is defined as "vehicle body left side" and the direction denoted with arrow R in the same is defined as "vehicle body right side", respectively.

The bending/stretching link 122 corresponding to the stand 21 included in the left boom 12 and the bending/stretching link 122 corresponding to the stand 21 included in the right boom 12 have an identical arrangement. The left bending/stretching link 122 and the right bending/stretching link 122 respectively, as shown in FIGS. 17 and 18, include a boom-side link 122A supported to the boom 12 and a stand-side link 122B supported to the stand 21.

The boom-side link 122A is supported to the boom 12 via a support shaft 122*c* which rotatably supports a base portion of the boom-side link 122A and the boom coupling frame 15 which supports the support shaft 122*c* at the supporting portions 15*a*. The boom-side link 122A is swingable with respect to the boom 12 about the support shaft 122*c* as the pivot point. At a free end portion of the boom-side link 122A, there is provided a stand supporting portion 122*s* capable of supporting the stand 21 engaged on the ground by propping. The stand-side link 122B, as shown in FIGS. 17 and 18, is supported to the stand 21 via a coupling shaft 122*d*. The stand-side link 122B is swingable with respect to the stand 21 about the coupling shaft 122*d* as the pivot point. The free end of the boom-side link 122A and the free end of the stand-side link 122B are coupled to be swingable relative to each other via a coupling shaft 122*e*.

Figure 18:
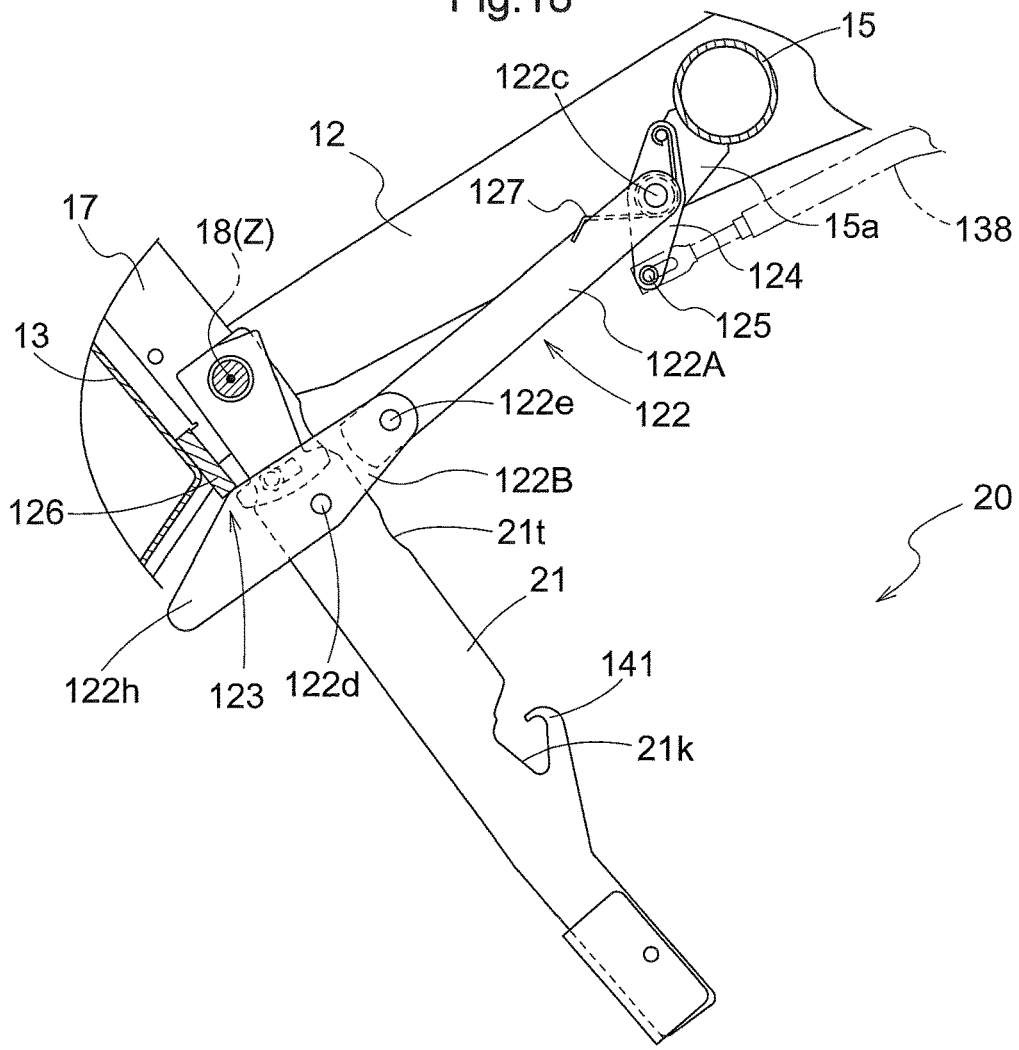
FIG. 18 is a left side view showing the bending/stretching link under a state for raising the stand.

As shown in FIG. 18, as the stand-side link 122B is swung about the coupling shaft 122*d*, the boom-side link 122A and the stand-side link 122B are swung relative to each other via the coupling shaft 122*e* as the pivot point, whereby the bending/stretching link 122 is operated to the bending side or to the stretching side.

Figure 17:
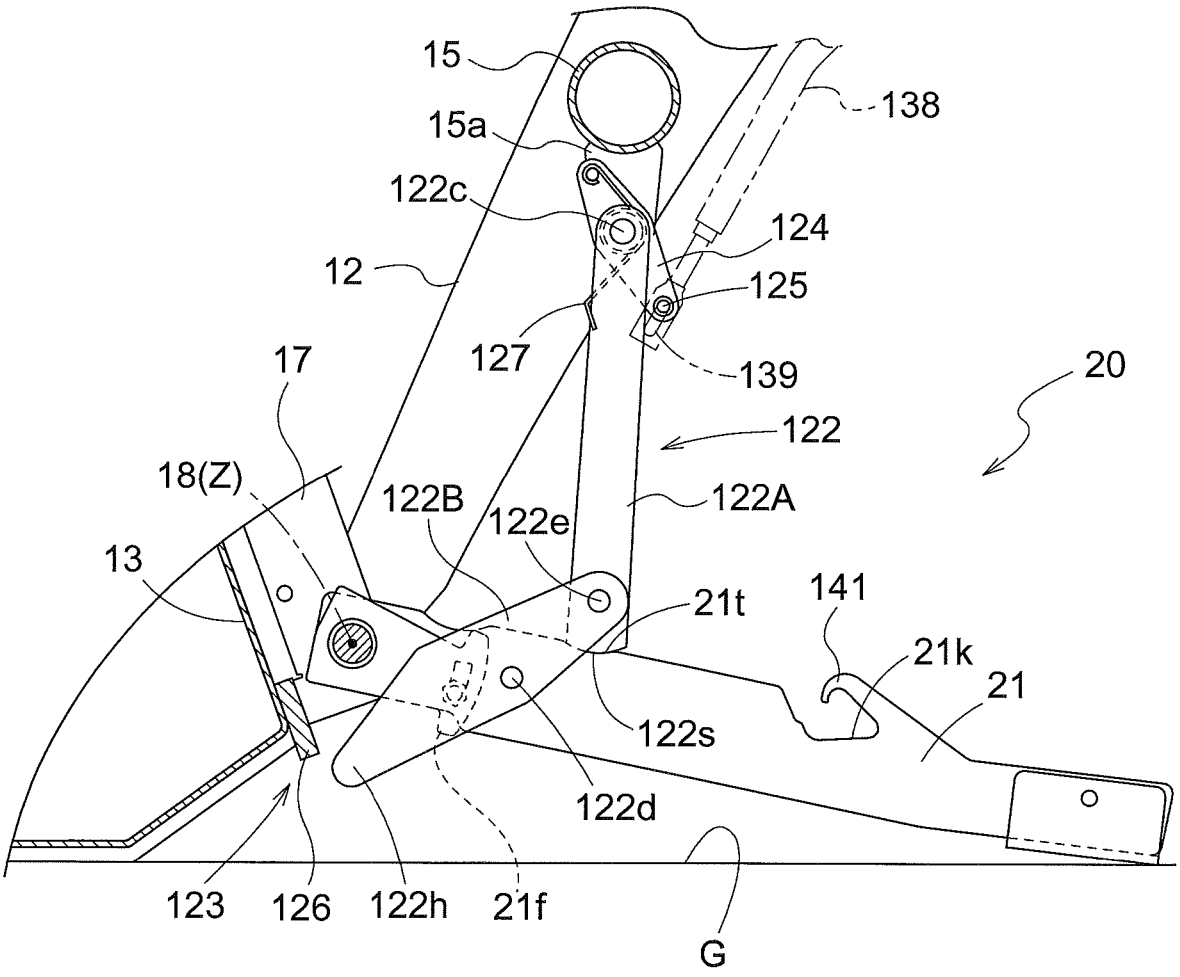
FIG. 17 is a left side view showing a bending/stretching link under a state to prop and support a stand engaged on the ground.

In the bending/stretching link 122, as shown in FIG. 17, when operated to the stretching side, as a stand supporting portion 122*s* of the boom-side link 122A comes into abutment against a back portion 21*t* of the stand 21 engaged on the ground, the boom-side link 122A props and supports the stand 21 as engaged on the ground.

In the bending/stretching link 122, as shown in FIG. 18, as the stand-side link 122B is swung relative to the stand 21 in the direction of forward movement of the free end portion having the coupling shaft 122*e* of the stand-side link 122B, the bending/stretching link 122 is operated to the bending side opposite to the side for propping and supporting the stand 21 as engaged on the ground. When the bending/stretching link 122 is operated to bend to the bending side opposite to the side for propping and supporting the stand 21 as engaged on the ground, a rising swing movement of the stand 21 relative to the boom 12 is enabled.

The link operating mechanism 123 corresponding to the let stand 21 and the link operating mechanism 123 corresponding to the right stand 21 have an identical arrangement. The left link operating mechanism 123 and the right link operating mechanism 123 respectively, as shown in FIGS. 17 and 18, include an operation target portion 122*h* provided in the stand-side link 122B and a link operating portion 126 provided in the bucket 13.

The operation target portion 122*h* is provided at a free end portion of the stand-side link 122B which portion is located on the side opposite to the side where the coupling shaft 122*e* is located relative to the pivot point (coupling shaft 122*d*) relative to the stand 21. The link operating portion 126 is provided at the back portion of the bucket 13. As the bucket 13 is swung in the lowering side (earth discharging side) relative to the boom 12, the link operating portion 126 is swung to the rear side about the coupling shaft 18 as the pivot point to come into abutment against the operation target portion 122*h* from the front side thereof, thus pressing this operation target portion 122*h* to the rear side.

In the link operating mechanism 123, as the bucket 13 is swung to the lowering side (earth discharging side) to swing the stand-side link 122B by the link operating portion 126, the bending/stretching link 12 is swung by the swing force of the bucket 13 so that this bending/stretching link 12 is bent to the bending side opposite to the side for propping and supporting the stand 21 as engaged on the ground.

In the link operating mechanism 123, as the bucket 13 is swung to the lowering side (earth discharging side) to swing the stand-side link 122B by the link operating portion 126 so that the bending/stretching link 123 is bent, the stand 21 is swung upwards relative to the boom 12, thus being switched over in its posture from the ground-engaging state to the raised/stored posture.

When the bucket 13 is supported to the boom 12 under the rising side (scooping side) posture, the link operating portion 126 and the operation target portion 122*h* are brought into positional relationship under which pressing of the link operating portion 126 to the operation target portion 122*h* is released. Thus, the bending/stretching link 122 is operated to the stretching side by the weight of the stand 21, thus allowing lowering of the stand 21 from the raised/stored posture to the lowed used posture.

Namely, when the bucket 13 is set to the state of being supported in the air to the boom 12 under the raised side posture (scooping side posture), the link operating portion 126 of the bucket 13 moves forwardly away from the operation target portion 122*h* of the stand-side link 122B, so that the left stand 21 and the right stand 21, respectively, is lowered under the gravity from the raised/stored posture relative to the boom 12. Under this state, if the boom 12 is lowered and, as shown in FIG. 17, the bucket 13 supported to the boom 12 under the raised-side posture (scooping side) is brought into contact with the ground G, in the left stand 21 and the right stand 21, respectively, the stand 21 is engaged on the ground and the stand supporting portion 122*s* of the boom-side link 122A comes into abutment against the back portion 21*t* of the stand 21 as engaged on the ground, so that the stand 21 is propped and supported under the ground engaged state by the boom-side link 122A. In this, as shown in FIG. 17, the bending/stretching link 122 assumes a posture in which the axis of the coupling shaft 122*e* is located on more rear aside than a straight line extending through the swing pivot point of the boom-side link 122A relative to the boom 12 and the swing pivot point of the stand-side link 122B relative to the stand 21. Even when the front loader 10 is detached from the travel vehicle body 1, this front loader 10 can stand by itself by the ground engagements of the bucket 13 and the stand 21.

Figure 21:
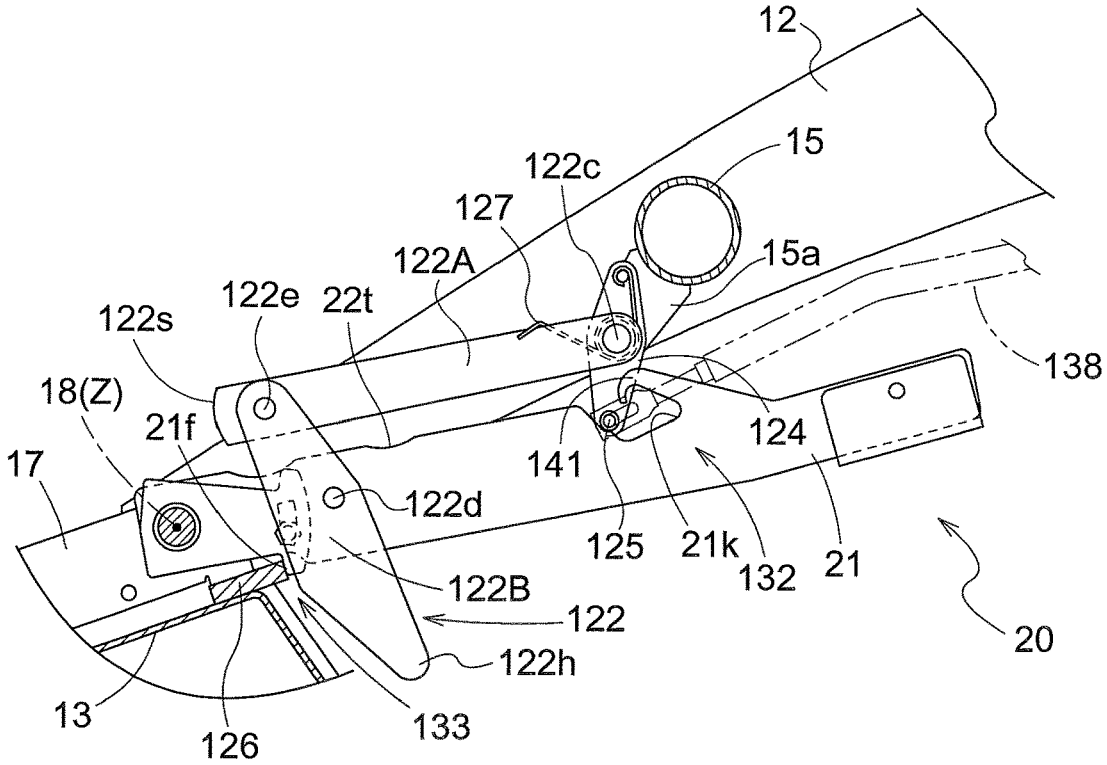
FIG. 21 is a left side view showing the stand under an inhibition releasing state of the inhibiting portion.

From the state of the bucket 13 and the stand 21 being engaged on the ground, if the boom 12 is raised, since the link operating portion 126 of the bucket 13 is forwardly away from the operation target portion 122*b* of the stand-side link 122B, as the stand 21 is moved away from the ground G, the stand 21 is swung to be lowered so that the stand supporting portion 122*s* of the boom-side link 122A is moved away from the back portion 21*t* of the stand 21. Thereafter, as shown in FIG. 18, when the bucket 13 is progressively swung to be lowered relative to the boom 12, the link operating portion 126 of the bucket 13 comes into abutment against the operation target portion 122*h* of the stand-side link 12B, thus progressively pressing the operation target portion 122*h* to the rear side. With this, the bending/stretching link 122 is operated to bend to the bending side opposite to the side of the case of propping and supporting the stand 21 as engaged on the ground and the stand 21 is raised toward the raised/stored posture by the bending/stretching link 122. When the stand 21 is raised to a position immediately before the raised/stored posture, as shown in FIG. 21, the link operating portion 126 of the bucket 13 comes into abutment against the operation target portion 21 formed at the base end portion of the stand 21, thus pressing the operation target portion 21*f*, and the stand 21 is operated to the raised/stored posture by the swing force of the bucket 13. The operation target portion 21*f* of the stand 21 is formed of a separate member attached to the stand 21. With this, by adjusting the attaching position of this separate member, the position of the operation target portion 21*f* can be adjusted. The arrangement is not limited to this. Instead, the operation target portion 21*f* can be formed integral with the stand 21.

The stand operation unit 130 includes a holding member 124 for holding the left stand 21 and the right stand 21 respectively under the raised/stored posture, a manually operable operation tool 131 for operating the holding member 124, an inhibiting portion 132 for the operation of the holding member 124 by the operation tool 131, and an inhibition switchover mechanism 133 for effecting switchover of the inhibiting portion 132.

Figure 19:
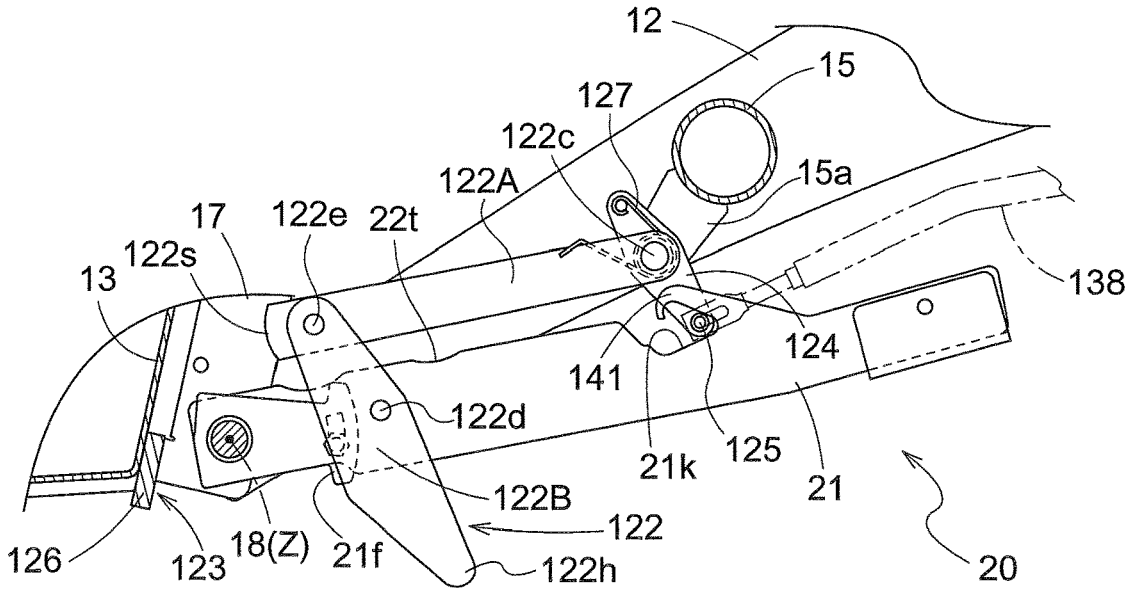
FIG. 19 is a left side view showing the stand as being held at the raised/storage posture by a holding member.

The holding member 124 for acting on the left stand 21 and the holding member 124 for acting on the right stand 21 have an identical arrangement. The holding member 124, as shown in FIG. 17 and FIG. 19, is non-rotatably supported to the support shaft 122*c* of the boom-side link 122A. The holding member 124 for acting on the left stand 21 and the holding member 124 for acting on the right stand 21 are operably coupled with each other via the support shaft 122*c* to swing by a same stroke in a same swing direction.

At a free end of the holding member 124, a retaining pin 125 is provided. As shown in FIG. 19, the holding member 124 is swung about the support shaft 122*c* as the swing pivot point and becomes engaged with the stand 21 as the retaining pin 125 engages into the cut-out portion 21*k* of the stand 21. Then, the holding member 124 assumes a holding posture for holding the stand 21 under the raised/stored posture by the retaining pin 125. When this holding member 124 is swung about the support shaft 122*c* as the swing pivot point and the retaining pin 125 is withdrawn from the cut-out portion 21*k*, the holding member 124 is detached from the stand 21. Then, the holding member 124 assumes a holding releasing posture to release the holding of the stand 21 under the raised/stored posture. The holding member 124 is urged to the holding releasing posture by the spring 127. The spring 127 is supported to the support shaft 127 as a coil portion thereof is fitted on the support shaft 122*c*.

Figure 22:
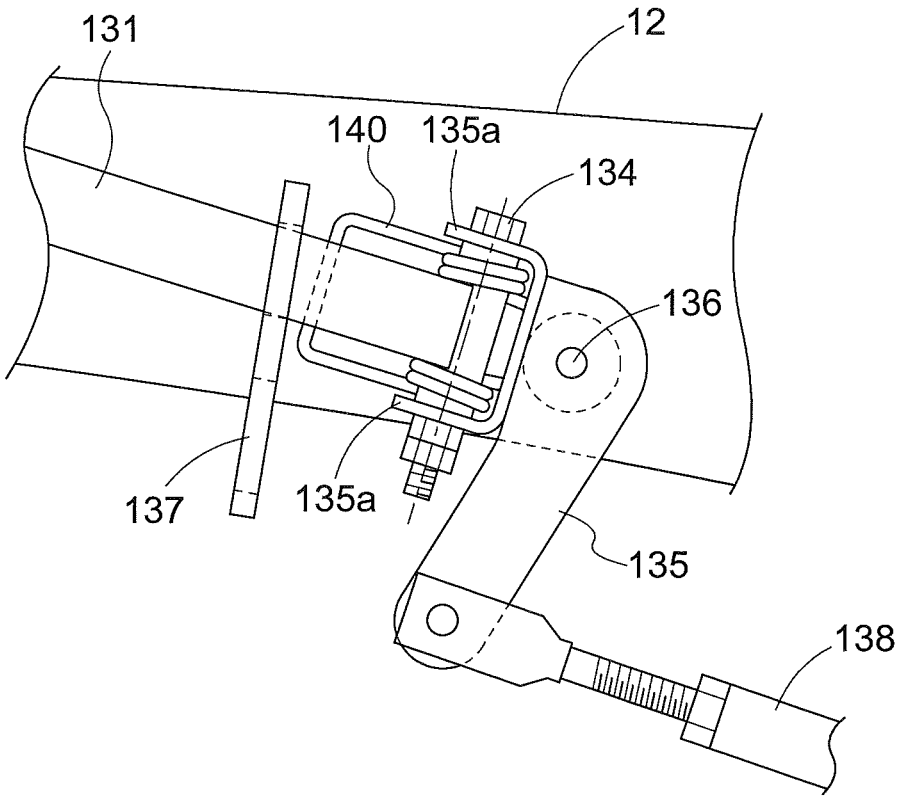
FIG. 22 is a side view showing an operation tool.
Figure 23:
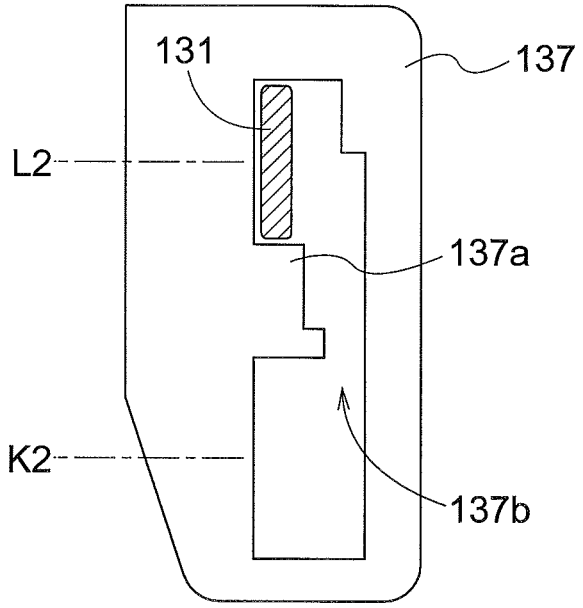
FIG. 23 is a rear view showing an operation tool guide and an operation position of the operation tool.

As shown in FIG. 22, the operation tool 131 is supported to the left boom 12 via a first support shaft 134 supporting the base portion of the operation tool 131, a coupling member 135 supporting the first support shaft 134 with a pair of supporting portions 135*a* thereof, and a second support shaft 136 supporting the coupling member 135. When the operation tool 131 is swung in the lateral width direction of the front loader 10 about the first support shaft 134 as the swing pivot point, the operation tool 131 is moved between a positioning portion 137*a* of an operation tool guide 137 and a guide groove 137*b* of the operation tool guide 137. When the operation tool 131 is swung along the guide groove 137*b* in the vertical direction of the front loader 10 about the second support shaft 136 as the swing pivot point, the operation tool 131 is switched over between a locked position L2 located at an upper portion of the guide groove 137*b* and an unlocked position K2 located at a lower portion of the guide groove 137*b*.

As shown in FIG. 22, the operation tool 131 and the coupling member 135 are operably coupled to each other via the first support shaft 134. As shown in FIG. 15 and FIG. 16, an operation rod 138 is connected to/between the coupling member 135 and the left holding member 134. The connection between the operation rod 138 and the left holding member 124 is provided by an elongate hole 139 defined at the front end portion of the operation rod 138 and the retaining pin 125 engageable into the elongate hole 139. The left holding member 124 and the right holding member 124 are operably coupled to each other via the support shaft 122*c*. With this, coupling is established between the operation tool 131 and the left and right respective holding members 124, so that the left and right holding members 124 can be operated by the operation tool 131.

As shown in FIG. 21, in case the bucket 13 is supported to the boom 12 under the second set posture (earth discharging posture), the link operating portion 126 of the bucket 13 comes into abutment against the operation target portion 21*f* of the stand 21, so that the stand 21 is received and supported by the bucket 13 so as not to be lowered by gravity from the raised/stored posture.

Under the state when the stand 21 is received and supported under the raised/stored posture, if the operation tool 131 is operated to the locked position L2, as shown in FIG. 18, the operation rod 138 is pulled to the rear side and the holding member 124 is pulled by the operation rod 138, thus being swung against the urging force of the spring 127, so that the retaining pin 125 engages via an entrance/exit opening into the cut-out portion 21*k* of the stand 12; thus, the holding member 124 assumes the holding posture. As the operation tool 131 is retained to the upper portion of the positioning portion 137*a* of the operation tool guide 137, the operation tool 131 is urged and engaged to the positioning portion 137*a* by a spring 140 and the operation tool 131 is held at the locking position L2 by the positioning portion 137*a* against the urging force of the spring 127; thus, the holding member 124 is held under the holding posture.

Under the state when the stand 21 is received and supported under the raised/stored posture, if the operation tool 131 is operated to the unlocked position K2, the operation rod 138 is pulled to the forward side, thus displacing the elongate hole 139 of the operation tool 138 to the forward side, so that the holding member 124 is swung by the spring 127 and the retaining pin 125 is moved out of the cut-out portion 21*k* of the stand 21; thus, the holding member 124 assumes the holding releasing posture. As the operation tool 131 is retained to the lower portion of the positioning portion 137*a* of the operation tool guide 137, the operation tool 131 is held at the unlocked position K2 by the positioning portion 137*a* and the operation rod 138 is held to the unlocking side.

As shown in FIG. 19, on the rear side of the entrance/exit opening of the cut-out portion 21*k* of the stand 21, there is formed a hook-shaped stopper portion 141 capable of receiving and supporting the retaining pin 125. In case the operation tool 131 is located at the unlocked position L2, as shown in FIG. 19, the retaining pin 125 is located at the inner position of the cut-out portion 21*k*.

Figure 20:
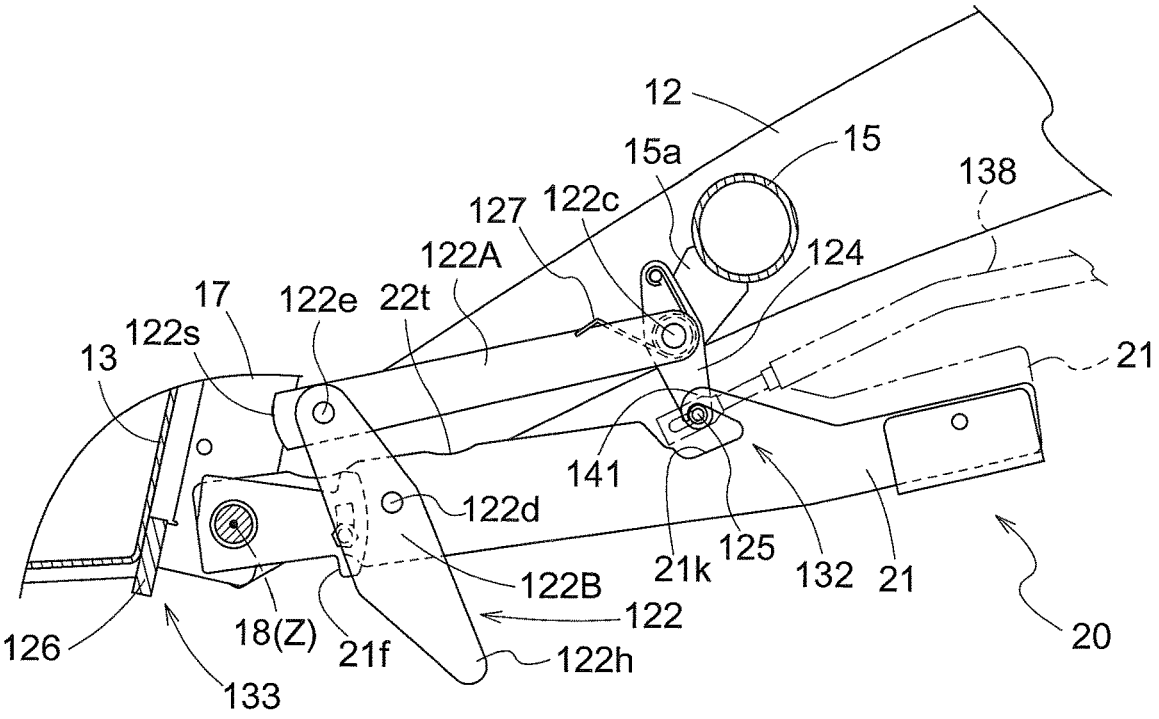
FIG. 20 is a left side view showing the stand under an inhibition effective state of an inhibiting portion.

As shown in FIG. 19 and FIG. 20, in case the bucket 13 is supported to the boom 12 under the first set posture (scooping posture), the link operating portion 126 of the bucket 13 is moved forwardly away from the operation target portion 21*f* of the stand 21, so the stand 21 is allowed to be lowered by the gravity from the raised/stored posture. Under this state, if the operation tool 13 is switched to the unlocked position K2, as shown in FIG. 20, in response to a swing operation of the holding member 124 by the spring 127, the retaining pin 125 is moved from the inner position of the cut-out portion 21*k* toward the entrance/exit opening. However, in association with this movement of the retaining pin 125, the stand 12 is lowered by the gravity from the raised/stored posture and the retaining pin 125 comes into abutment against the stopper portion 141 to be received and stopped thereby, thus not moving to the entrance/exit opening, so withdrawal of the retaining pin 125 from the cut-out portion 21*k* is prevented by the stopper portion 141. After the retaining pin 125 is received and stopped by the stopper 141, movement of the operation rod 138 to the forward side is allowed by relative movement between the operation rod 138 and the retaining pin 125. Different from the foregoing case, in case the bucket 13 is supported to the boom 12 under the second set posture, as shown in FIG. 19, even if the retaining pin 125 is moved toward the entrance/exit opening of the cut-out portion 21*k*, the stand 21 will not be lowered from the raised/stored posture as being received and supported by the bucket 13 and the stopper 141 does not provide its effect, so the retaining pin 125 is moved to the entrance/exit opening of the cut-out portion 21*k* and moved out of this cut-out portion 21*k*.

The inhibiting portion 132 for the operation of the holding member 124 by the operation tool 131 is constituted of the stopper portion 141 and the elongate hole 139. And, as shown in FIG. 20, when the bucket 13 is supported to the boom 12 under the first set posture, the inhibiting portion 132 enters an inhibition effective posture for inhibiting detachment of the holding member 124 relative to the stand 21 in spite of switchover of the operation tool 131 to the unlocked position K2. As shown in FIG. 21, when the bucket 13 is supported to the boom 12 under the second set posture, the inhibiting portion 132 enters an inhibition releasing state for allowing detachment (release of the holding member 124 relative to the stand 21 in response to switchover of the operation tool 131 to the unlocked position K2.

The inhibition switchover mechanism 133 for effecting switchover of the inhibiting portion 132 is constituted of the link operating portion 126 of the bucket 13 and the operation target portion 21*f* of the stand 21. And, as shown in FIG. 20, the inhibition switchover mechanism 133 maintains the inhibiting portion 132 under the inhibition effective state when the bucket 13 is supported to the boom 12 under the first set posture. As shown in FIG. 21, the inhibition switchover mechanism 133 switches the inhibiting portion 132 over to the inhibition releasing state when the bucket 13 is supported to the boom 12 under the second set posture.

The bucket 13 will be set under the state of being supported to the boom 12 under the first set posture, e.g. when the travel vehicle body 1 to which the front loader 10 is coupled is to be parked. Then, the inhibiting portion 132 is maintained under the inhibition effective state by the inhibition switchover mechanism 133. Therefore, even if the operation tool 131 is switched to the unlocked position by e.g. a malicious mischief, as the holding member 124 is maintained under the holding posture, the stand 21 will be kept under the raised/stored posture by the holding member 124. If the engine is stopped, the bucket cylinder 19 cannot be driven, thus preventing the bucket 13 from being operated to the second set posture. Thus, the state of maintaining the stand 21 under the raised/stored posture by the holding member 124 can be ensured even more reliably.

Figure 24:
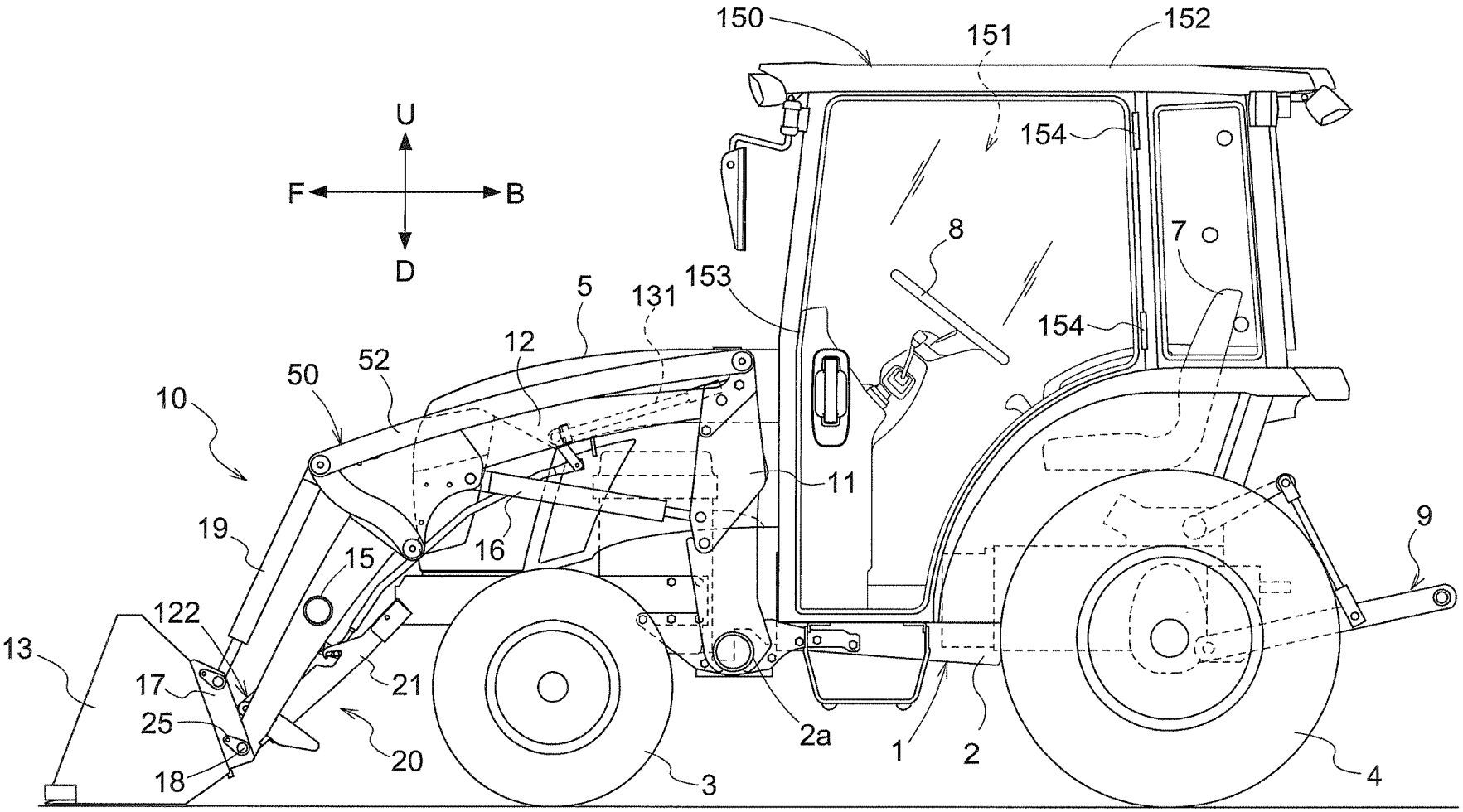
FIG. 24 is a left side view showing a tractor having a further embodiment in its entirety.

(2) FIG. 24 is a left side view showing a tractor having a further embodiment in its entirety. The tractor according to the further embodiment includes a riding type driving section 150 and a driving cabin 152 which covers a riding space 151 of the riding type driving section 150.

The driving cabin 152 includes, at a lateral wall portion thereof, an access door 153. The access door 153 is supported to the lateral wall portion via a plurality of support shafts 154 in the vehicle body vertical direction provided at a plurality of positions in a vehicle body rear portion of the access door 153, so that the door 153 can be opened/closed about the support shafts 154 as the swing pivot points. The operation tool 131 is disposed at a position accessible by a hand through an access opening from the riding space 151 when the access door 153 is opened. So, a driver can operate the operation tool 131 without having to get off the riding type driving section.

Instead of the arrangement where the operation tool 131 is operated by a hand extended out of the access opening, it is possible to employ an arrangement in which an opening opened in the front wall portion of the driving cabin 152 is provided so as to allow a hand to be extended from the riding space 151 through the access opening. Further alternatively, it is possible to employ an arrangement in which the operation tool 131 enters the riding space 151 through the access opening.

(3) In the foregoing embodiment, the operation portions (stand operating portions 26) for causing the link operating members 28 to slide are arranged on the bucket 13, but the operation portions may be arranged and implemented on a component other than the bucket 13.

(4) In the foregoing embodiment, the stands 21 are provided inward, in the lateral direction of the vehicle body, of the booms 12, but may also be provided outward, in the lateral direction of the vehicle body, of the booms 12.

(5) In the foregoing embodiment, each of the link operating members 28 is provided between the left and right longitudinal plate portions 21A of the stand 21, but may also be provided outside the stand 21, for example, laterally outside the stand 21.

(6) In the foregoing embodiment, the stand operating portions 26 for pressing the stands 21 serve as the pressing operation portions for pressing the link operating members 28. Depending on the arrangement of the link operating members 28, however, the stand operating portions 26 and the pressing operation portions may be separate members by providing the link operating members 28 outside the stands 21, for example.

(7) In the foregoing embodiment, the holding members 24 and the operation tool 33 are operably coupled to each other via the wires 35, but a configuration can also be employed in which they are operably coupled to each other via a link, an interlocking rod, or the like.

(8) In the foregoing embodiment, the operation tool 33 is supported by the left coupling frame 11, but the operation tool 33 may be supported by the right coupling frame 11 instead. Furthermore, a configuration can also be employed in which the operation tool 33 is supported on any portion of the front loader 10 other than the coupling frames 11.

(9) In the foregoing embodiment, the unlock operation tool 42 may be gripped together with the operation portion 33*a* of the operation tool 33. Instead thereof, the unlock operation tool 42 may be provided on the operation portion 33*a* so that the unlock operation tool 42 is operable by a finger of the hand that supports the operation portion 33*a*.

(10) In the foregoing embodiment, the common operation tool 33 is used for the operation of changing the posture of the holding member 24 of the left stand unit 20 and for the operation of changing the posture of the holding member 24 of the right stand unit 20. Instead thereof, an operation tool for changing the posture of the holding member 24 of the left stand unit 20 and an operation tool for changing the posture of the holding member 24 of the right stand unit 20 may be provided and implemented separately.

(11) The present invention is applicable to not only front loaders that are coupled to tractors but also front loaders that are coupled to various types of vehicles, such as a front loader operation-dedicated vehicle.

While certain embodiments of the invention are shown in the accompanying figures and described herein above in detail, other embodiments will be apparent to and readily made by those skilled in the art without departing from the scope and spirit of the invention. For example, it is to be understood that this disclosure contemplates that to the extent possible, one or more features of any embodiment can be combined with one or more features of the other embodiment. Accordingly, the foregoing description is intended to be illustrative rather than restrictive.

The invention claimed is:

1. A front loader comprising:

a boom configured to be removably coupled to a vehicle body;

a bucket supported at a front end of the boom;

a stand configured to support the boom, when removed from the vehicle body, in a state in which the bucket is engaged on the ground;

a boom-side link swingably supported on the boom, the boom-side link being configured to prop and support the stand engaged on the ground as the free end thereof comes into abutment against the stand engaged on the ground; and a stand-side link swingably supported on the stand;

wherein as the stand-side link is swung relative to the stand by a swing force of the bucket, the boom-side link is swung by the stand-side link so that at least a portion of the boom-side link is positioned higher than the boom.

2. The front loader of claim 1, further comprising:

a holder posture-switchable between a holding posture in which the holder is engaged with the stand for holding the stand at a raised and stored posture and a holding releasing posture in which the holder is released from the stand;

an operation tool manually operable into a locked position for switching the holder to the holding posture and an unlocked position for switching the holder to the holding releasing posture;

an inhibiting portion switchable between an inhibition effective state for inhibiting release of the holder relative to the stand in spite of switchover of the operation tool to the unlocked position and an inhibition releasing state for allowing release of the holder relative to the stand; and an inhibition switchover mechanism configured to maintain the inhibiting portion under the inhibition effective state as the bucket is supported to the boom under a first set posture and to switch the inhibiting portion to the inhibition releasing state as the bucket is supported to the boom under a second set posture.

3. The front loader of claim 2, wherein the vehicle body comprises a vehicle body of a working machine.

* * * * *